US012760473B2

(12) United States Patent
Smith et al.

(10) Patent No.: US 12,760,473 B2
(45) Date of Patent: Oct. 13, 2026

(54) MOVEABLE POINT FROG FRICTION-REDUCING ASSEMBLY

(71) Applicant: voestalpine Railway Systems Nortrak LLC, Sheridan, WY (US)

(72) Inventors: Bradley Gene Smith, Vestavia, AL (US); Brent Alan Duffner, Pinson, AL (US); Derek Stephen Cameron, Birmingham, AL (US)

( * ) Notice: Subject to any disclaimer, the term of this patent is extended or adjusted under 35 U.S.C. 154(b) by 578 days.

(21) Appl. No.: 18/202,852

(22) Filed: May 26, 2023

(65) Prior Publication Data

US 2024/0392512 A1 Nov. 28, 2024

(51) Int. Cl.
*E01B 7/14* (2006.01)

(52) U.S. Cl.
CPC ..... *E01B 7/14* (2013.01)

(58) Field of Classification Search
CPC ... E01B 7/14; E01B 2202/042; E01B 2202/06
USPC ..... 246/382, 392, 430
See application file for complete search history.

(56) References Cited

U.S. PATENT DOCUMENTS 474,200 A * 5/1892 Vaughn ..... E01B 7/14 246/276
2,979,295 A 4/1961 Hewes
4,105,175 A * 8/1978 De Spiegeleer ..... E01B 7/02 246/453
4,953,814 A * 9/1990 Oswald ..... E01B 7/14 246/389
5,127,613 A * 7/1992 Germann ..... E01B 7/02 246/453
5,499,786 A 3/1996 Durchschlag et al.
5,501,418 A 3/1996 Humphrey et al.
5,509,626 A 4/1996 Fodor
5,628,480 A 5/1997 Vrsecky et al.
6,189,840 B1 2/2001 Mantovan et al.
6,464,177 B1 10/2002 Heim
6,732,980 B2 5/2004 Hein
7,063,293 B2 6/2006 Leitner et al.
(Continued)

FOREIGN PATENT DOCUMENTS

AU 2017261622 A1 6/2018
CN 103132399 A 6/2013
(Continued)

OTHER PUBLICATIONS

CN 112064426 Translation (Year: 2020).*
(Continued)

*Primary Examiner* — S. Joseph Morano
(74) *Attorney, Agent, or Firm* — Tasty IP, Limited

(57) ABSTRACT

A solution is disclosed comprising a moveable point frog friction-reducing assembly configured for installation at or near a moveable point frog (also referred to as a swing nose crossing). In one aspect, the moveable point frog friction-reducing assembly is configured to use a plurality of roller assemblies to reduce friction. In another aspect, the moveable point frog friction-reducing assembly is configured to use a sliding block to reduce friction. Some of the many benefits of the disclosed solution are to increase the operational life of a moveable point frog, reduce the maintenance costs of a moveable point frog, and to protect property, and more importantly human lives.

13 Claims, 33 Drawing Sheets

(56) References Cited

U.S. PATENT DOCUMENTS

| | | | |
|---|---|---|---|
| 7,766,283 | B2 | 8/2010 | Lesemann et al. |
| 8,608,115 | B2 | 12/2013 | Ruetzel et al. |
| 8,672,274 | B2 | 3/2014 | Albisua Aspiazu |
| 8,684,317 | B2 | 4/2014 | Arnold |
| 9,309,629 | B2 | 4/2016 | Ashkenazi et al. |
| 10,106,933 | B2 | 10/2018 | Keightley et al. |
| 11,236,470 | B2 | 2/2022 | Reiser et al. |
| 11,447,917 | B2 | 9/2022 | Reiser |
| 2002/0079634 | A1 | 6/2002 | Lesemann |
| 2007/0284484 | A1 | 12/2007 | Lesemann et al. |
| 2008/0087773 | A1 | 4/2008 | Meyer |
| 2009/0056585 | A1 | 3/2009 | Leitner et al. |
| 2011/0042527 | A1 | 2/2011 | Foan |
| 2020/0385932 | A1 | 12/2020 | Staribacher et al. |

FOREIGN PATENT DOCUMENTS

| | | | | | |
|---|---|---|---|---|---|
| CN | 103806350 | A | | 5/2014 | |
| CN | 112064426 | A | * | 12/2020 | ..... E01B 7/22 |
| CN | 216739063 | U | | 6/2022 | |
| DE | 3420505 | A1 | | 12/1985 | |
| DE | 10215280 | A1 | | 8/2003 | |
| DE | 102005032417 | A1 | | 1/2007 | |
| DE | 102014212074 | A1 | | 12/2015 | |
| EP | 389851 | A2 | | 10/1990 | |
| EP | 571357 | A2 | * | 11/1993 | ..... E01B 7/02 |
| EP | 0692570 | A1 | | 1/1996 | |
| EP | 0964100 | A2 | | 12/1999 | |
| EP | 1055778 | A2 | | 11/2000 | |
| EP | 1194649 | A1 | | 4/2002 | |
| EP | 2653611 | A1 | | 10/2013 | |
| EP | 2708646 | A2 | | 3/2014 | |
| EP | 2735649 | A2 | | 5/2014 | |
| EP | 2743154 | A2 | | 6/2014 | |
| EP | 2995718 | A1 | | 3/2016 | |
| FR | 2685020 | A1 | * | 6/1993 | ..... E01B 7/02 |
| GB | 2202563 | A | * | 9/1988 | ..... E01B 7/02 |
| GB | 2417508 | A | | 3/2006 | |
| GB | 2442850 | A | | 4/2008 | |
| JP | 2003034248 | A | | 2/2003 | |
| JP | 3824851 | | | 9/2006 | |
| JP | 2007332696 | A | | 12/2007 | |
| KR | 20100115110 | A | | 10/2010 | |
| KR | 20120066440 | A | | 6/2012 | |
| WO | 2005017258 | A1 | | 2/2005 | |
| WO | 2007140879 | A1 | | 12/2007 | |
| WO | 2008106708 | A1 | | 9/2008 | |
| WO | 2009129759 | A1 | | 10/2009 | |
| WO | 2019120339 | A1 | | 6/2019 | |

OTHER PUBLICATIONS

FR 2685020 Translation (Year: 1993).*

EP 571357 Translation (Year: 1993).*

Blue Roll (TM) Point Roller Brochure, URL: https://www.voestalpine.com/nortrak/static/sites/nortrak/.downloads/BlueRoll-Roller-Brochure-Dec-2020.pdf, retrieved on Jan. 28, 2024, archived at: https://web.archive.org/web/20211020125724/https://www.voestalpine.com/nortrak/static/sites/nortrak/.downloads/BlueRoll-Roller-Brochure-Dec-2020.pdf, dated Dec. 2020.

Ekoslide, "Products", URL: https://www.ekoslide.cz/en/product/, retrieved on Jan. 28, 2024, Archived at: https://web.archive.org/web/20230529220036/https://www.ekoslide.cz/en/product/, Archive dated: May 29, 2023.

Fox Trade GmbH Website, URL: http://www.foxtrade.net/ENGLISH/innovationenE.html, original date unknown, Archive URL: https://web.archive.org/web/20080724185456/http:/www.foxtrade.net/ENGLISH/innovationenE.html, archive dated: Jul. 24, 2008, original website down.

IAT International Ekoslide Technical Brochure, URL: https://iatint.com/wp-content/uploads/2018/07/IAT_Ekoslide_Technical_Brochure.pdf, retrieved on: Jan. 28, 2024, initial publication unknown, Archived at: https://web.archive.org/web/20240128185609/https://iatint.com/wp-content/uploads/2018/07/IAT_Ekoslide_Technical_Brochure.pdf, Archived on Jan. 28, 2024.

IAT International Products Website, URL: https://iatint.com/switch-components/, retrieved on: Jan. 28, 2024, initial publication date unknown, Archived at: https://web.archive.org/web/20230202110000/https://iatint.com/switch-components/, archived on Feb. 2, 2023.

Rama, et al., "A Reliability Analysis of Railway Switches", Proceedings IMechE Part F: J Rail and Rapid Transit 227(4) 344-363, DOI: 10.1177/0954409713481725, dated Feb. 6, 2013.

Wieland Group, "Austroroll®—Doppelrolle montieren | Installation Double-Roller," Original URL: https://www.youtube.com/watch?v=mBKNNTJFChs, Original URL Dated: Oct. 23, 2023, Retrieved on: Mar. 1, 2024, Archived URL: https://web.archive.org/web/20240301201114/https://www.youtube.com/watch?v=mBKNNTJFChs, Archive Dated Mar. 1, 2024.

Wieland Group, "Austroroll®—Einzelrolle montieren | Installation Single-Roller," Original URL: https://www.youtube.com/watch?v=S1175VP1sMY, Originally Dated: Oct. 23, 2023, Retrieved on: Mar. 1, 2024, Archived URL: https://web.archive.org/web/20240301195551/https://www.youtube.com/watch?v=S1175VP1sMY, Archived on: Mar. 1, 2024.

Wieland Group, "Austroroll®—Function control" Original URL: https://www.youtube.com/watch?v=qz2DGMOj1OY, Originally Dated: Oct. 23, 2023, Retrieved on: Mar. 1, 2024, Archived URL: https://web.archive.org/web/20240302001900/https://www.youtube.com/watch?v=qz2DGMOj1OY, Archived on: Mar. 1, 2024.

Wieland Group, "Austroroll®—Functions Control Inspection," Author: Wieland Group, Original URL: https://www. youtube.com/watch?v=KvxwwbnYLrk, Originally Dated: Oct. 23, 2023, Retrieved on: Mar. 1, 2024, Archived URL: https://web.archive.org/web/20240302002645/https://www.youtube.com/watch?v=KvxwwbnYLrk, Archived on: Mar. 1, 2024.

Wieland Group, "Austroroll®—HSR—Functions Control," Original URL: https://www.youtube.com/watch?v=R7dyE1tkDQA, Originally Dated: Oct. 23, 2023, Retrieved on: Mar. 1, 2024, Archived URL: https://web.archive.org/web/20240302002128/https://www.youtube.com/watch?v=R7dyE1tkDQA, Archived on: Mar. 1, 2024.

Wieland Group, "Austroroll®—HSR—Installation Rollers," Original URL: https://www.youtube.com/watch?v=eescVInW4FM Originally Dated: Oct. 23, 2023 Retrieved on: Mar. 1, 2024 Archived URL: https://web.archive.org/web/20240302000748/https://www.youtube.com/watch?v=eescVInW4FM Archived on: Mar. 1, 2024.

Wieland Group, "Austroroll®—Wartungsfreie Rollvorrichtung für Eisenbahnweichen Roller device for railway points," Original URL: https://www.youtube.com/watch?v=vfHhjEMqcRM, Originally Dated Oct. 23, 2023, Retrieved on Feb. 29, 2024, Archived URL: https://web.archive.org/web/20240301171939/https://www.youtube.com/watch?v=vfHhjEMqcRM, Archived on: Mar. 1, 2024.

Wieland Group, "Check plate solution," Original URL: https://www.youtube.com/watch?v=pbNJhJS6f94, Originally Dated: Jul. 9, 2020, Retrieved on: Mar. 1, 2024, Archived URL: https://web.archive.org/web/20240301193415/https://www.youtube.com/watch?v=pbNJhJS6f94, Archived on: Mar. 1, 2024.

Wieland Group, "Concrete direct attachment," Original URL: https://www.youtube.com/watch?v=pJw8bMpxWz4, Originally Dated: Jul. 9, 2020, Retrieved on: Mar. 1, 2024, Archived URL: https://web.archive.org/web/20240301193833/https://www.youtube.com/watch?v=pJw8bMpxWz4, Archived on: Mar. 1, 2024.

Wieland Group, "Fastening using threshold screws," Original URL: https://www.youtube.com/watch?v=QKajBQUV1Ts, Originally Dated: Jul. 9, 2020, Retrieved on: Mar. 1, 2024, Archive URL: https://web.archive.org/web/20240301191912/https://www.youtube.com/watch?v=QKajBQUV1Ts&themeRefresh=1, Archived on: Mar. 1, 2024.

Wieland Group, "Mark & clean threshold compartments," Original URL: https://www.youtube.com/watch?v=CDNXfoha_yQ, Originally Dated: Jul. 9, 2020, Retrieved on: Mar. 1, 2024, Archived URL: https://web.archive.org/web/20240301181848/https://www.youtube.com/watch?v=CDNXfoha_yQ, Archived on: Mar. 1, 2024.

Wieland Group, "Measure cutting length," Original URL: https://www.youtube.com/watch?v=CDNXfoha_yQ, Originally Dated: Jul. 9, 2020, Retrieved on: Mar. 1, 2024, Archived URL: https://web.

(56) References Cited

OTHER PUBLICATIONS archive.org/web/20240000000000*/https://www.youtube.com/watch?v=CDNXfoha_yQ, Archived on: Mar. 1, 2024.
Wieland Group, "Product Autroroller" Website, URL: https://www.wieland.com/en/products/product-categories/roller-device-for-railway-points/austroroll-assembly, retrieved on Mar. 7, 2024, archived URL: https://web.archive.org/web/20230923201708/https://www.wieland.com/en/products/product-categories/roller-device-for-railway-points/austroroll-assembly, archive dated Sep. 23, 2023.
Wieland Group, "Roller device for railway points" Website, original URL: https://www.wieland.com/en/products/roller-device-for-railway-points, original URL retrieved on Feb. 29, 2024, archived URL: https://web.archive.org/web/20231210142041/https://www.wieland.com/en/products/roller-device-for-railway-points, archive dated Dec. 10, 2023.
Wieland Group, "Wood direct attachment cutting aid," Original URL https://www.wieland.com/var/site/storage/images/4/9/5/0/880594-1-eng-GB/cfab5f884938-3c-Cutting-aid.jpg, Originally Dated: Unknown, Retrieved on: Mar. 1, 2024, Archived URL: https://web.archive.org/web/20240301195027/https://www.wieland.com/var/site/storage/images/4/9/5/0/880594-1-eng-GB/cfab5f884938-3c-Cutting-aid.jpg, Archived on: Mar. 1, 2024.
Wieland Group, "Wood direct attachment," Original URL: https://www.youtube.com/watch?v=of2vTYMM9p8, Originally Dated: Jul. 9, 2020, Retrieved on: Mar. 1, 2024, Archived URL: https://web.archive.org/web/20240301192841/https://www.youtube.com/watch?v=of2vTYMM9p8, Archived on: Mar. 1, 2024.
Havlíček et al., Experience With Explosive Hardening of Railway Frogs From Hadfield Steel, Conference Metal 2012, Brno, Czech Republic, dated May 25, 2012, URL https://www.researchgate.net/publication/260037340_Experience_with_explosive_hardening_of_railway_frogs_from_Hadfield_steel, retrieved Apr. 15, 2023.
Voestalpine Railway Systems Nortrak, Frogs, dated Apr. 19, 2021, URL: https://www.voestalpine.com/nortrak/static/sites/nortrak/.downloads/Frog-Brochure-9-2015.pdf (retrieved Apr. 15, 2023).
Wikipedia, Swingnose Crossing, URL: https://en.wikipedia.org/wiki/Swingnose_crossing, retrieved on Apr. 15, 2023.

* cited by examiner

MOVEABLE POINT FROG FRICTION-REDUCING ASSEMBLY

BACKGROUND

Railways comprise many turnouts that provide the various routes for railway vehicles. Part of each turnout is a frog (also known as a crossing). Traditionally, frogs are fixed, in that the components within the frog do not move. Rather, a switch operating device provides movement of switch point rails that, in turn, cause the vehicle to proceed from the main line and into the divergent line via the frog.

Fixed frogs have a number of drawbacks. First, the wheelset requires a certain geometry in order to cross the frog without causing excessive contact force between the wheelsets and the rail. Thus, varying wheel geometries may not easily be used on the same fixed frog without introducing excess noise, vibration, and maintenance. Second, fixed frogs require a guard rail in order to ensure the wheels do not derail when passing through the frog. Thus, the guard rails are one more component in the track that requires maintenance and replacement over time. Third, fixed frogs cannot accommodate high speed turns. Since the wheel is not fully in contact with the rail, the risk of derailment increases with higher velocities.

Even in optimal conditions, fixed frogs are noisy and create excess vibration. The noise and vibration may be uncomfortable for passengers in the vehicle. Likewise, the noise may be disturbing to travelers in stations. In sum, fixed frogs have many limitations that prevent the progress of rail transportation.

Moveable point frogs (or swing nose crossings) address many of the shortcomings of fixed frogs. As the name suggests, moveable point frogs have a moving point that diverts the vehicle from the main line to the divergent line. The primary advantage is the wheelset maintains contact with the running edge throughout the crossing. Therefore, the moveable point frog is capable of supporting many wheel geometries since the contact surface within the crossing is substantially similar to the contact surface of the stock rail.

As such, vehicles may travel at higher velocities since, again, the wheelset is in substantially continuous contact with the rail surface. As the world adopts more high-speed rail, moveable point frogs will be used to enable higher velocities which, in turn, provide alternatives to higher-carbon modes of travel (e.g., airplane).

In contrast to fixed frogs, moveable point frogs do not require a guard rail since the wheelset is in substantially continuous contact with the rail and is much less likely to derail. Therefore, the maintenance costs associated with guard rails is eliminated.

However, moveable point frogs have maintenance challenges. The moveable point frog comprises a sliding plate upon which the moveable point traverses between the wing rails. The friction created thereby increases maintenance costs since the components require inspection, service, and replacement. For instance, service may require a lubricant to be administered at regular intervals.

What is needed is a solution to improve the interaction between the sliding plate and the moveable point. One such solution is disclosed herein.

SUMMARY

A solution is disclosed for a moveable point frog friction-reducing assembly that may be configured for installation at or near a moveable point frog. The moveable point frog friction-reducing assembly may comprise a first base plate assembly, a first wing clamp, wherein the first wing clamp may be operatively connected to the first base plate assembly. The moveable point frog friction-reducing assembly may comprise a second wing clamp, wherein the second wing clamp may be operatively connected at the first base plate assembly. The moveable point frog friction-reducing assembly may comprise a first horizontal tension assembly that may be operatively connected to the first wing clamp and the second wing clamp.

The moveable point frog friction-reducing assembly may further comprise a second horizontal tension assembly that may be operatively connected to the first wing clamp and the second wing clamp. The moveable point frog friction-reducing assembly may further comprise a first vertical tension assembly that may be operatively connected to the first wing clamp and the first base plate assembly. The moveable point frog friction-reducing assembly may further comprise a second vertical tension assembly that may be operatively connected to the second wing clamp and the first base plate assembly. The moveable point frog friction-reducing assembly may further comprise a first friction-reducing assembly that may be operatively connected to the first base plate assembly.

The friction-reducing assembly may be a roller block assembly that may comprise a first roller retainer body, a first roller assembly that may be operatively connected to the first roller retainer body as well as a second roller assembly that may be operatively connected to the first roller retainer body. The first roller retainer body may comprise a first roller receiver that may be configured to hold in position the first roller assembly at a first roller axle that may be, in turn, operatively connected to the first roller assembly as well as a second roller receiver that may be configured to hold in position the second roller assembly at a second roller axle that may be, in turn, operatively connected to the second roller assembly, wherein the first roller receiver may be configured to hold in position the first roller axle via a first roller axle retainer.

The first friction-reducing assembly may alternatively be a first sliding block. In one aspect, the first sliding block may be ultra-high molecular weight polyethylene ("UHMWPE"), high-density polyethylene ("HDPE"), low-density polyethylene ("LDPE"), polytetrafluoroethylene ("PTFE"), Delrin ("acetal plastic"), or a combination thereof. The slide block may comprise a ramp, wherein the ramp is disposed about a perimeter of a dorsal surface of the slide block. The slide block may further comprise a plurality of holes, wherein the plurality of holes is configured to support a plurality of bushings, wherein the plurality of bushings is configured to compress the slide block and cause a plurality of bolts to lock into position when the slide block is installed into the base plate assembly.

The first roller axle retainer may comprise a first hole that may be configured to receive a first hex screw and may be further configured to retain the first hex screw at or below a dorsal surface of the first axle retainer. The first roller assembly may comprise a first needle bearing and a first bushing that may be operatively connected to the first roller axle and the first needle bearing. The first vertical tension assembly may comprise a first hex bolt that may be disposed through the first wing clamp and the first base plate assembly as well as a first plurality of Belleville springs, wherein the first hex bolt may be disposed through the plurality of Belleville springs. The first vertical tension assembly further may comprise a first washer that may be disposed on a dorsal surface of the first plurality of Belleville springs as well as a first nut that may be disposed at a dorsal surface of the first washer as well as a first lock nut that may be disposed at a dorsal surface of a first locking washer, which is disposed at a dorsal surface of the first nut.

The first vertical tension assembly may further comprise a second washer that may be disposed on a ventral surface of the first base plate assembly between the first hex bolt and the base plate assembly. The first base plate assembly may comprise a first plurality of holes that may be configured to operatively connect to the first friction-reducing assembly as well as a second plurality of holes that may be configured to operatively connect to the first friction-reducing assembly.

The first base plate assembly may comprise a first hole that may be configured to operatively connect, via the first vertical tension assembly, the first base plate assembly to the first wing clamp as well as a first slotted hole that may be configured to operatively connect the first base plate assembly, via the second vertical tension assembly, to the second wing clamp.

A sliding assembly is disclosed that may be configured for installation in a moveable point frog friction-reducing assembly. The sliding assembly may comprise a slide block, a first plurality of bushings that may be disposed in a first plurality of holes within the slide block, respectively as well as a first plurality of bolts that may be disposed at a plurality of dorsal surfaces of the first plurality of bushings, respectively. The slide block may be ultra-high molecular weight polyethylene ("UHMWPE"), high-density polyethylene ("HDPE"), low-density polyethylene ("LDPE"), polytetrafluoroethylene ("PTFE"), Delrin ("acetal plastic"), or a combination thereof. The first plurality of bolts may be configured to receive a plurality of nuts that may be configured to secure the first plurality of bolts to a surface of a first base plate assembly. The first plurality of dorsal surfaces may be configured to receive the the first plurality of bolts at or below the plurality of dorsal surfaces of the slide block. The slide block may comprise a ramp, wherein the ramp is disposed about a perimeter of the dorsal surface of the slide block. The slide block may further comprise a plurality of holes, wherein the plurality of holes is configured to support a plurality of bushings, wherein the plurality of bushings is configured to compress the slide block and cause a plurality of bolts to lock into position when the slide block is installed into the base plate assembly.

A roller block assembly is disclosed that may be configured for installation in a moveable point frog friction-reducing assembly. The roller block assembly may comprise a first roller retainer body. The roller block assembly may further comprise a first roller assembly that may be operatively connected to the first roller retainer body as well as a second roller assembly that may be operatively connected to the first roller retainer body. The first roller retainer body may comprise a first roller receiver that may be configured to hold in position the first roller assembly at a first roller axle that may be, in turn, operatively connected to the first roller assembly as well as a second roller receiver that may be configured to hold in position the second roller assembly at a second roller axle that may be, in turn, operatively connected to the second roller assembly, wherein the first roller receiver may be configured to hold in position the first roller axle via a first roller axle retainer.

The first roller axle retainer may comprise a first hole that may be configured to receive a first hex screw and may be further configured to retain the first hex screw at or below a dorsal surface of the first roller axle retainer. The first roller assembly may comprise a first needle bearing and a first bushing that may be operatively connected to the first roller axle and the first needle bearing. The roller block assembly may comprise a first bearing seal.

BRIEF DESCRIPTION OF DRAWINGS

The accompanying drawings, which are incorporated herein and constitute part of this specification, illustrate exemplary aspects of the claims, and together with the general description given above and the detailed description given below, serve to explain the features of the claims.

DETAILED DESCRIPTION

Various aspects will be described in detail with reference to the accompanying drawings. Wherever possible, the same reference numbers will be used throughout the drawings to refer to the same or like parts. References made to particular examples and implementations are for illustrative purposes, and are not intended to limit the scope of the claims.

Figure 1A:
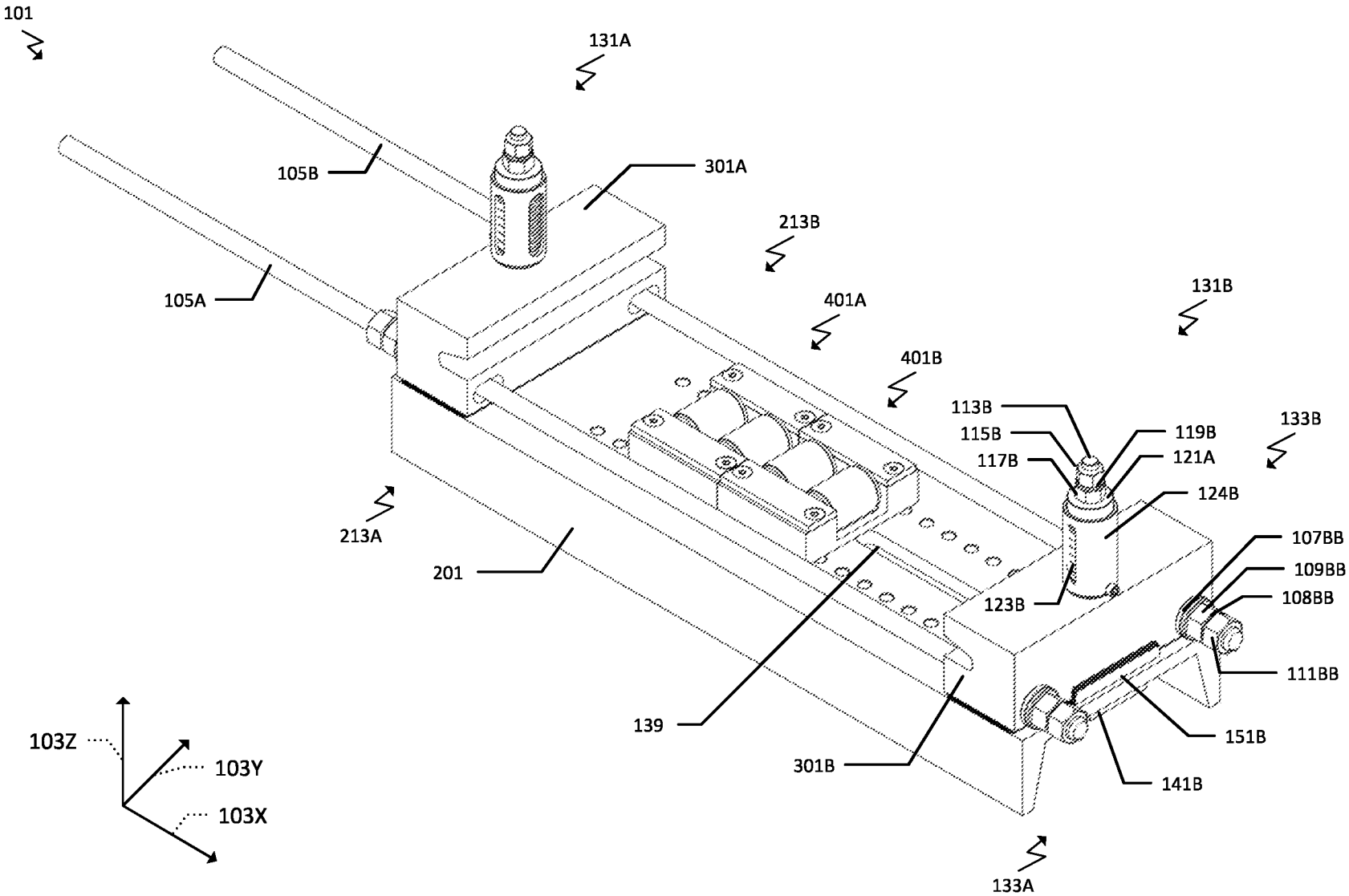
FIG. 1A is a perspective view illustrating a moveable point frog friction-reducing assembly, as shown from a three-quarters perspective.

FIG. 1A is a perspective view illustrating a moveable point frog friction-reducing assembly 101, as shown from a three-quarters perspective. The moveable point frog friction-reducing assembly 101 is generally configured to reduce the friction of a moveable point frog via installation at or near the moveable point frog. The moveable point frog friction-reducing assembly 101 is generally configurable for installation at various rail gauges and is further configurable in the field in order to fit to the unique dimensions of a particular moveable point frog. In one aspect, multiple moveable point frog friction-reducing assemblies may be installed at various points of a single moveable point frog, i.e., at any point that may benefit from reduced friction during transition of the moveable point.

In order to provide reference to the viewer, a plurality of axes is provided, namely a first axis 103X, a second axis 103Y, and a third axis 103Z. The first axis 103X is perpendicular to the direction of travel of a railway vehicle traveling down a track. The second axis 103Y is parallel to the direction of travel of a railway vehicle traveling down the track. The third axis 103Z is the normal formed by the axes 103X, 103Y—in other words, the vertical direction.

The moveable point frog friction-reducing assembly 101 comprises a base plate assembly 201. The base plate assembly 201 is operatively connected to a first wing clamp 301A and a second wing clamp 301B. The wing clamps 301A, 301B are configured to provide operative connection to the bases of a rail that are, in turn, part of a moveable point frog.

The wing clamp 301A is operatively connected to the base plate assembly 201 via a vertical tension assembly 131A via a hole (not shown). Similarly, the wing clamp 301B is operatively connected to the base plate assembly 201 via a vertical tension assembly 131B via a slotted hole 139. The slotted hole 139 provides adjustability along a first threaded rod 105A and a second threaded rod 105B. As such, the wing clamps 301A, 301B may be adjusted and attached to a rail (e.g., at or near a moveable point frog).

A horizontal tension assembly 133B is comprised of a threaded rod 105B, a washer 107BB, a nut 109BB, a locking washer 108BB, and a lock nut 111BB. The nut 109BB is adjusted along the threaded rod 105B. The lock nut 111BB and the locking washer 108BB provide a secondary source of tension to hold the wing clamp 301B in position. The lock nuts described herein may be nylon insert, distorted thread, and/or steel insert (e.g., security nuts). Further, the lock nut 111B protects the horizontal tension assembly 133B from (1) vibration generated by passing railway vehicles, (2) seismic shifting, and (3) tampering by malicious humans. The horizontal tension assembly 133B further comprises a second washer 107BA, a nut 109BA, a locking washer 108BA, and a lock nut 111BA at the opposing side of the second wing clamp 301A. A second horizontal tension assembly 133A is similarly comprised for the threaded rod 105A. The horizontal tension assemblies 133A, 133B are generally configured to fix the movable point frog friction-reducing assembly 101 at or near the moveable point frog.

The vertical tension assembly 131B comprises a hex bolt 113B, a square washer 141B, a plurality of Belleville springs 123B, a sleeve 124B, a piston 121A, a nut 117B, a locking washer 119B, and a lock nut 115B. The head of the hex bolt 113B and the square washer 141B provide opposition to the force of the plurality of Belleville springs 123B. Since the plurality of Belleville springs 123B may be under considerable stress, the sleeve 124B provides additional stability to maintain alignment of the plurality of Belleville springs 123B. Such alignment provides for safety and reduced maintenance costs.

One of skill in the art will appreciate that alternative washers may be used in lieu of the square washers (such as structural washers). Further, one of skill in the art will appreciate that the washers (e.g., the washer 141B) may be any type of shape (e.g., circular, square, rectangular, etc.).

In general, the wing clamps 301A, 301B are in a substantially fixed position when the moveable point frog friction-reducing assembly 101 is installed at or near the moveable point. However, the vertical tension assemblies 131A, 131B provide support for the moveable point while still providing any required movement along the axis 103Z.

A plurality of shims 151B is disposed between the wing clamp 301B and the base plate assembly 201. The plurality of shims 151B provide for adjustability of the wing clamp 301B with respect to the base plate assembly 201 (and associated rail). The plurality of shims 151B is in contact with one another but may be separated such the count of shims may be increased or reduced. For example, each shim may be 0.5 millimeters high in order to be combined to create a nominal height of 2.0 millimeters when four shims are combined. One of skill in the art will appreciate that the height of each shim may vary in order to provide various degrees of adjustability (e.g., a 1.0-millimeter height for each shim may be selected, thus requiring only two shims to generate a nominal height of 2.0 millimeters).

The vertical tension assembly 131A is similarly configured as the vertical tension assembly 131B, as shown in the instant view. However, the vertical tension assembly 131A is configured to remain in position via a hole (not shown) and not via a slotted hole (e.g., the slotted hole 139). Therefore, the wing clamp 301A is intended to be placed into position first and the wing clamp 301B is intended to be moved along the slotted hole 139 such that the moveable point frog friction-reducing assembly 101 is fixed in position at or near the moveable point frog.

The base plate assembly 201 is generally configured to support a friction-reducing assembly. The friction-reducing assembly is generally configured to reduce the friction of the moveable point frog when the moveable point transitions from position to position (e.g., substantially along the axis 103X). For example, the friction-reducing assembly enables the ventral surface of the moveable point to travel without unnecessary grinding with any supporting plates disposed below the moveable point. The disclosed solution primarily relies on two types of friction-reducing assemblies, namely (1) a roller-based assembly and (2) a sliding-block-based assembly. Both types of assembly serve the same general functionality of reducing friction and may be used both interchangeable and within the same configuration of the moveable point frog friction-reducing assembly 101. One particular advantage of the disclosed solution is the ability to replace the friction-reducing assembly without substantially reconfiguring the horizontal or vertical installation of the moveable point frog friction-reducing assembly 101. For example, the base plate assembly 201 may be removed in order to replace the friction-reducing assembly. Thus, reduced maintenance costs are achieved as well as increased safety.

As shown, the moveable point frog friction-reducing assembly 101 utilizes a roller-based friction-reducing assembly. Thus, the base plate assembly 201 is shown supporting a first roller block assembly 401A and a second roller block assembly 401B. The roller block assemblies 401A, 401B are configured to being fixed along the axis 103X of the base place assembly 201 via a first plurality of holes 213A and a second plurality of holes 213B. The pluralities of holes 213A, 213B provide for fasteners within the roller block assemblies 401A, 401B to attach to the base plate assembly 201. Therefore, the roller block assemblies 401A, 401B may be positioned along the axis 103X of the base plate assembly 201 in order to meet the field requirements of the moveable point frog.

The roller block assemblies 401A, 401B are generally configured to reduce the friction of a moveable point. The roller block assemblies 401A, 401B may be configured such that the moveable point is raised by a number of millimeters. The roller block assemblies 401A, 401B enable the lateral movement (along the axis 103X) such that lateral friction is reduced when the moveable point frog moves in the substantially same lateral direction. Thus, the requirement for lubricant of any supporting plates of the moveable point frog is reduced if not eliminated.

Figure 1B:
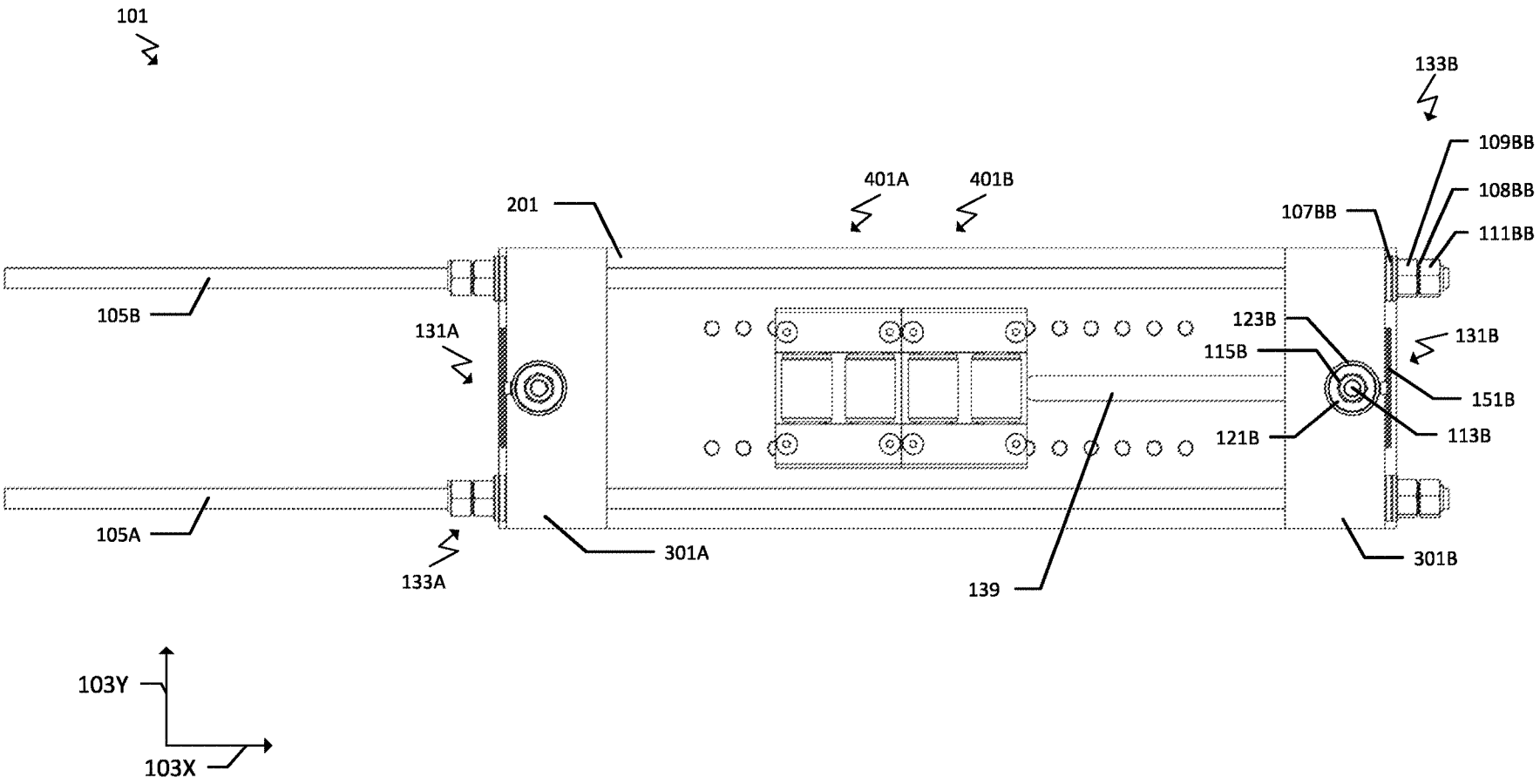
FIG. 1B is a planar view illustrating a moveable point frog friction-reducing assembly, as shown from a top perspective.

FIG. 1B is a planar view illustrating the moveable point frog friction-reducing assembly 101, as shown from a top perspective. The orientation of the vertical tension assemblies 131A, 131B is more clearly shown. Further, the slotted hole 139 is more visible in order to demonstrate the movement of the wing clamp 301B. One of skill in the art will appreciate that the roller block assemblies 401A, 401B may be installed along various positions of the base plate assembly 201.

Figure 1C:
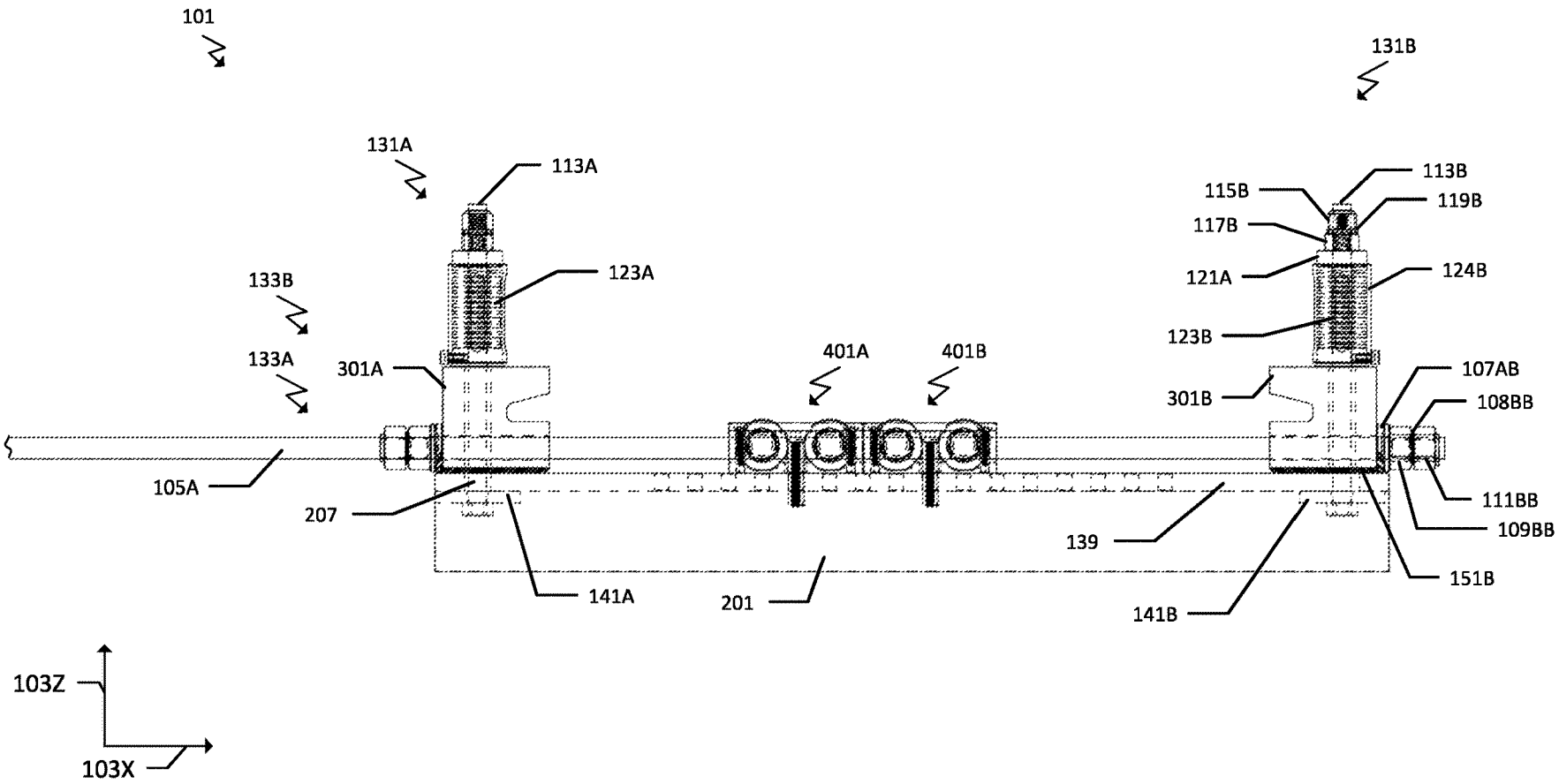
FIG. 1C is a planar view illustrating a moveable point frog friction-reducing assembly, as shown from a rear perspective.

FIG. 1C is a planar view illustrating the moveable point frog friction-reducing assembly 101, as shown from a rear perspective. The instant view shows in more detail the plurality of Belleville springs 123A, 123B. The hex bolts 113A, 113B are shown as passing through a hole 207 and the slotted hole 139, respectively. The square washers 141A, 141B are substantially in contact with the ventral face of the base plate assembly 201. The hex bolts 113A, 113B are substantially in contact with the square washers 141A, 141B. One of skill in the art will appreciate that the vertical tension assemblies 131A, 131B are positioned such that the moveable point frog friction-reducing assembly 101 may be operable to receive shocks within the rails while still providing stability during moveable point transitions.

One of skill in the art will appreciate that varying counts of Belleville springs may be used in the plurality of Belleville springs 123A, 123B as shown. For example, the plurality of Belleville springs 123A, 123B provide tension such that the moveable point may transition laterally with reduced friction. By providing reduced friction, the movable point avoids excessive contact with any supporting plate such that the need for lubricant is reduced if not eliminated. As such, maintenance costs are reduced and safety is enhanced. For instance, human personnel are no longer required to administer lubricant by hand.

Figure 1D:
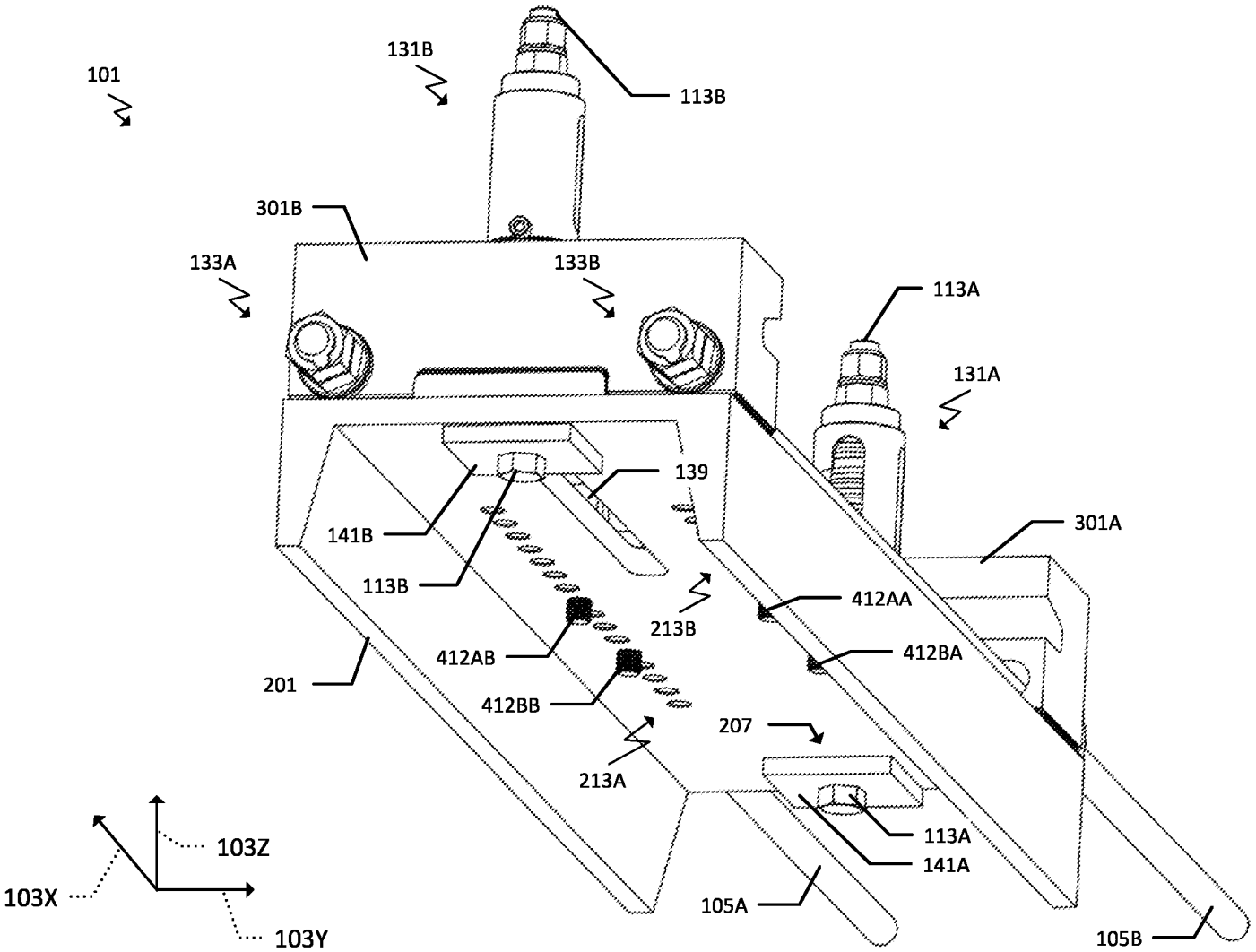
FIG. 1D is a perspective view illustrating a moveable point frog friction-reducing assembly, as shown from a three-quarters perspective.

FIG. 1D is a perspective view illustrating the moveable point frog friction-reducing assembly 101, as shown from a three-quarters perspective. The instant view depicts the ventral side of the moveable point frog friction-reducing assembly 101 in more detail. The washers 141A, 141B are shown as being in contact with the base plate assembly 201. Further, the hex bolts 113A, 113B are operatively connected to the washers 141A, 141B. As shown, the head of the hex bolts 113A, 113B are disposed on the ventral side of the base plate assembly.

A plurality of screws 412Z is installed into the base plate assembly 201 via a first plurality of holes 213A and a second plurality of holes 213B. The plurality of screws 412Z comprise a first screw 412AA, a second screw 412AB, a third screw 412BA, and a fourth screw 412BB. The screws 412AA, 412AB fix the roller assembly 409A in place. Likewise, the screws 412BA, 412BB fix the roller assembly 409B in place.

Figure 2A:
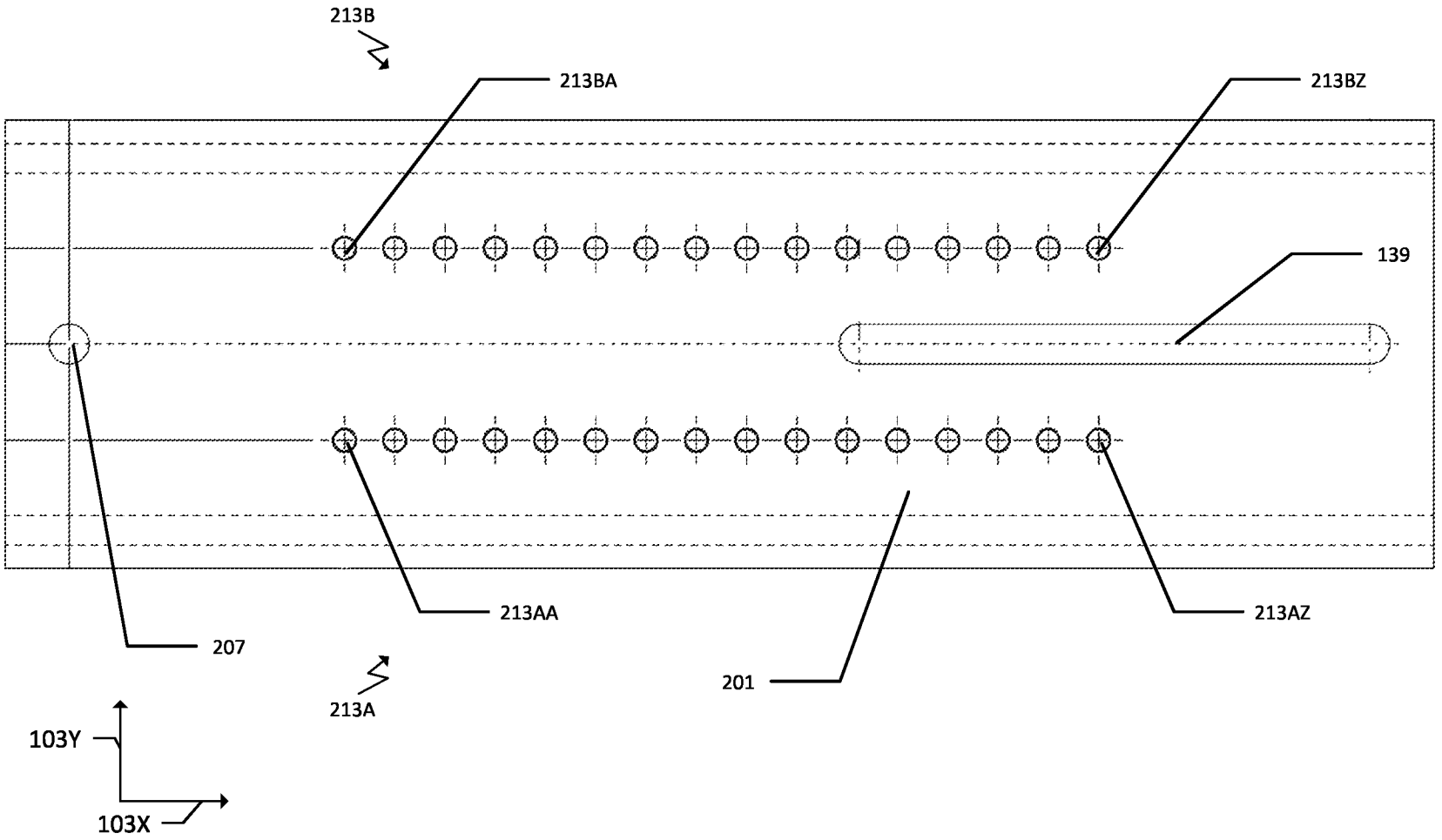
FIG. 2A is a planar view illustrating a base plate assembly, as shown from a top perspective.

FIG. 2A is a planar view illustrating the base plate assembly 201, as shown from a top perspective. The plurality of holes 213A is comprised of a first hole 213AA and a last hole 213AZ—as well as any number of intervening holes (e.g., as those shown in the instant view). Likewise, the plurality of holes 213B is comprised of a first hole 213BA and a last hole 213BZ—as well as any number of intervening holes (e.g., as those shown in the instant view). One of skill in the art will appreciate that the number of holes within the pluralities of holes 213A, 213B is mirrored such that the roller block assemblies 401A, 401B may be positioned along the axis 103X of the base plate assembly 201. Further, any type of friction-reducing assembly may be positioned using the pluralities of holes 213A, 213B.

Figure 2B:
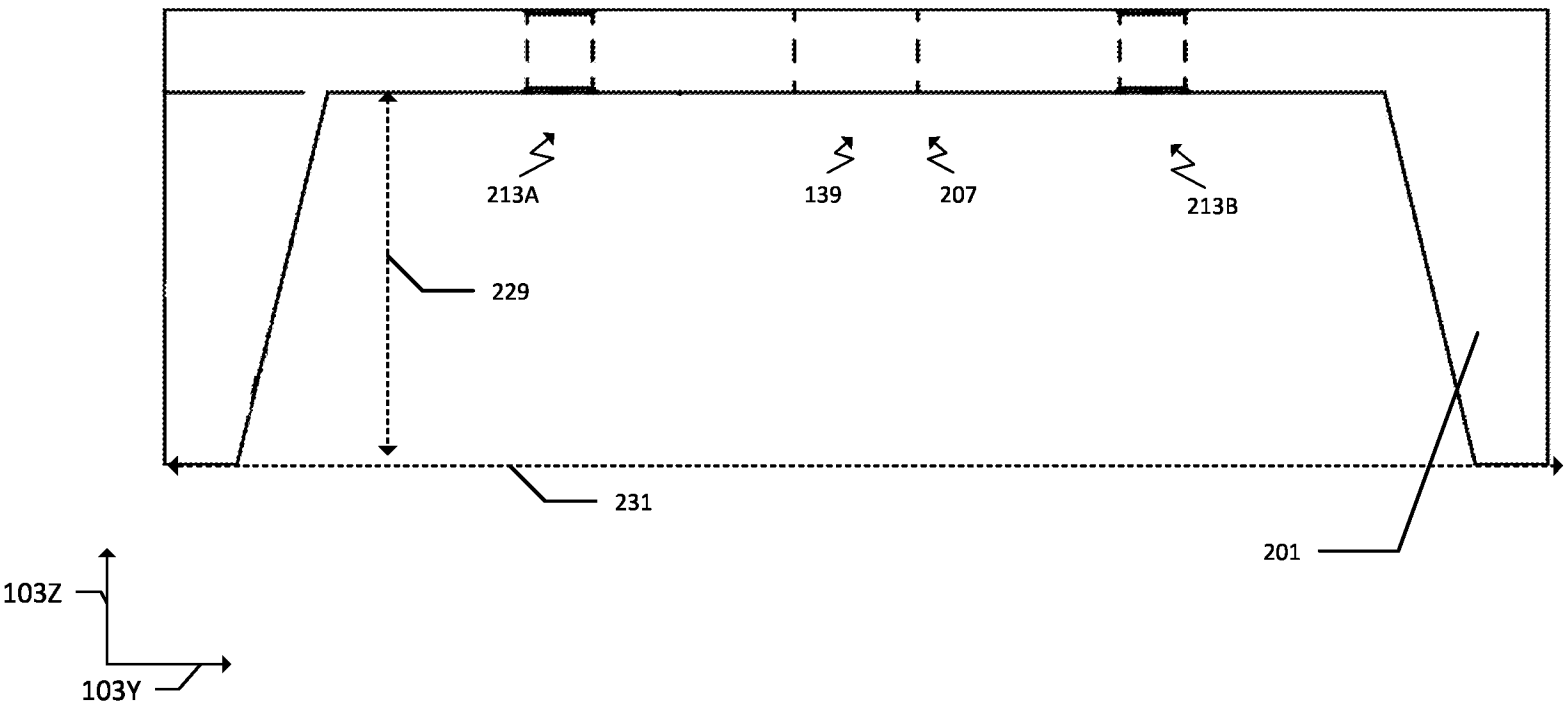
FIG. 2B is a planar view illustrating a base plate assembly, as shown from a side perspective.

FIG. 2B is a planar view illustrating the base plate assembly 201, as shown from a side perspective. A distance 229 is formed from the ventral face of the base plate assembly 201 to an axis 231 in order to highlight that the ventral face of the base plate assembly 201 is designed with enhanced structural integrity. The enhanced structural integrity better supports the moveable point. As such, safety is enhanced. Further, maintenance costs are reduced because the base plate assembly 201 has a longer operational life.

Figure 3A:
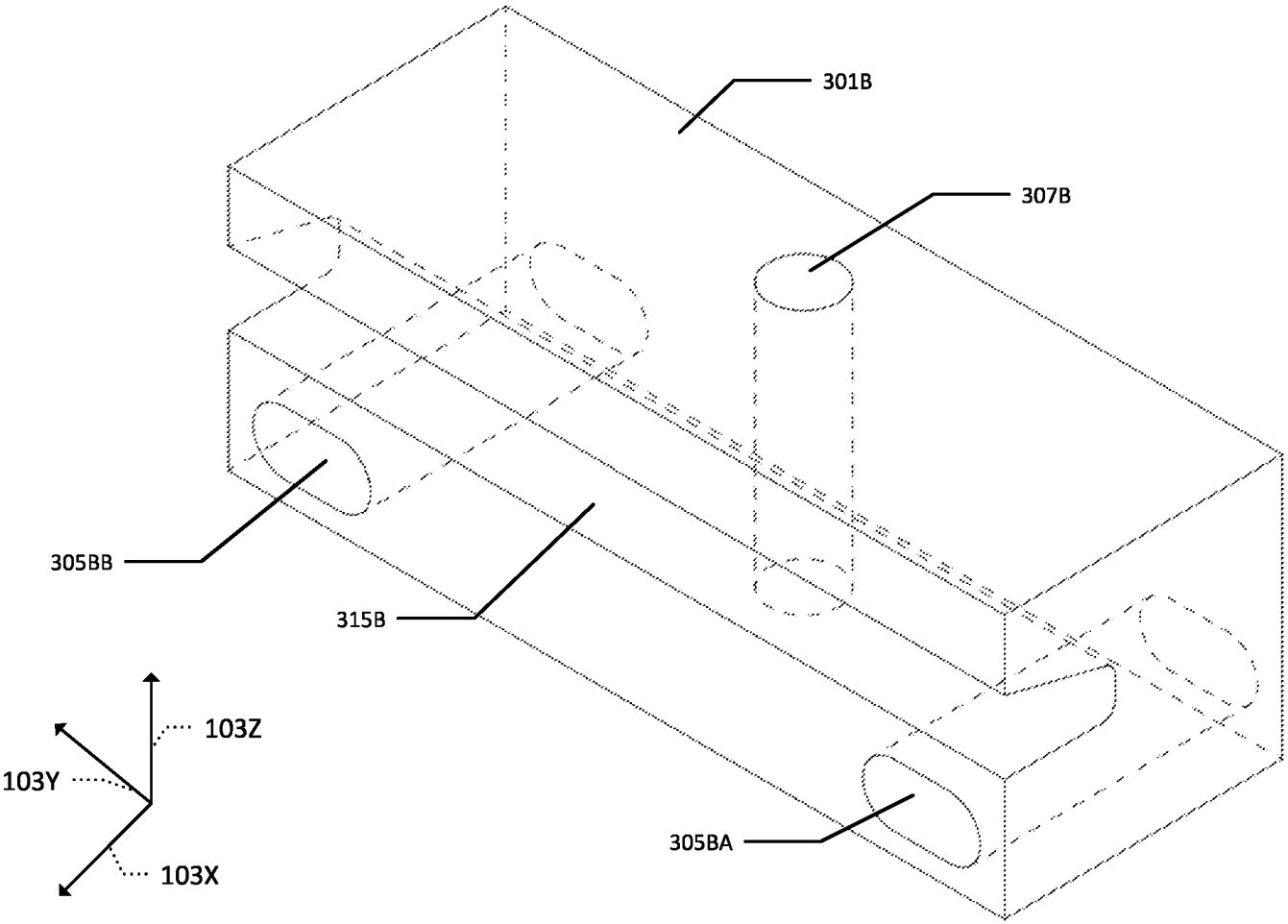
FIG. 3A is a perspective view illustrating a wing clamp, as shown from a three-quarters perspective.

FIG. 3A is a perspective view illustrating the wing clamp 301B, as shown from a three-quarters perspective. The wing clamp 301B comprises a first horizontally oriented slotted hole 305BA and a second horizontally oriented slotted hole 305BB. The slotted holes 305BA, 305BB are configured such that the threaded rods 105A, 105B may pass through the wing clamp 301B, respectively. The slotted nature of the slotted holes 305BA, 305BB provides for improved fitment with the rail such that excessive forces do not act upon the threaded rods 105A, 105B (and associated components and/or assemblies). Likewise, the wing clamp 301A has reciprocal slotted holes 305AA, 305AB (not shown in the instant view) and the holes 305AA, 305AB are similarly configured as the holes 305BA, 305BB (again to receive the threaded rods 105A, 105B, respectively).

The wing clamp 301B comprises a vertically oriented hole 307B, disposed in parallel to the axis 103Z. The hole 307B is configured such that the bolt 113B may pass through the wing clamp 301B. The wing clamp 301A comprises a similarly configured hole 307A (not shown in the instant view). The holes 307A, 307B enable the vertical tension assemblies 131A, 131B to affix the wing clamps 301A, 301B in place on the dorsal side of the base plate assembly 201.

A rail receiver 315B is disposed on the inner face of the wing clamp 301B. Similarly, the wing clamp 301A comprises a rail receiver 315A (not shown in the instant view), again facing inwardly. The rail receiver 315A is configured to be used in conjunction with the rail receiver 315B in order to operatively affix the moveable point frog friction-reducing assembly 101 to the base of a rail (not shown in the instant view). As shown in the instant view, the rail receiver 315B is configured for a standard rail. However, the profile of the rail receiver 315B may be machined and/or formed in order to fit other rail profiles without departing from the spirit and scope of the disclosed solution.

Figure 3B:
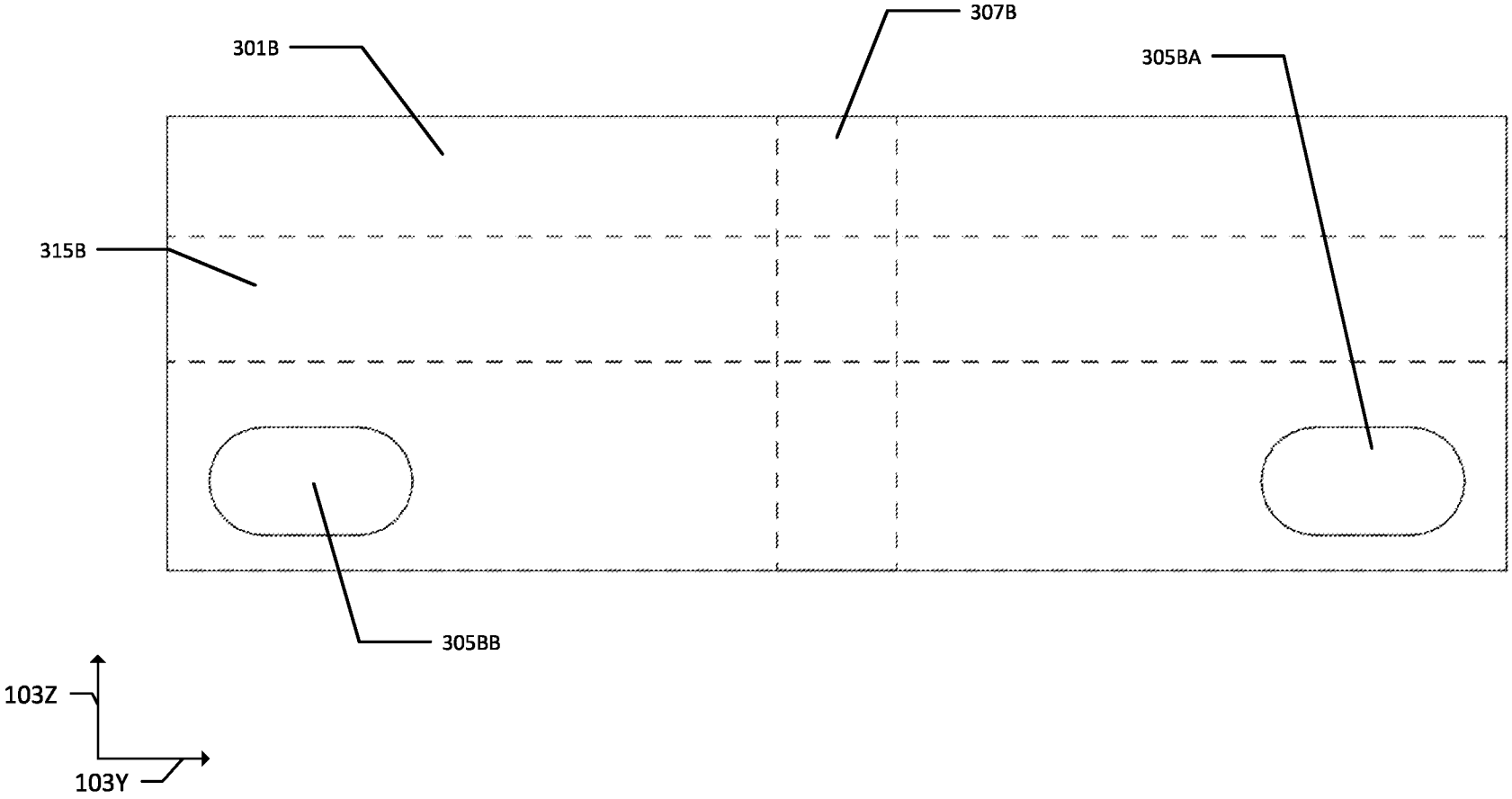
FIG. 3B is a planar view illustrating a wing clamp, as shown from a side perspective.

FIG. 3B is a planar view illustrating the wing clamp 301B, as shown from a side perspective. The slotted holes 305BA, 305BB are facing toward the viewer, along the axis 103X. The hole 307B is parallel to the axis 103Z.

Figure 3C:
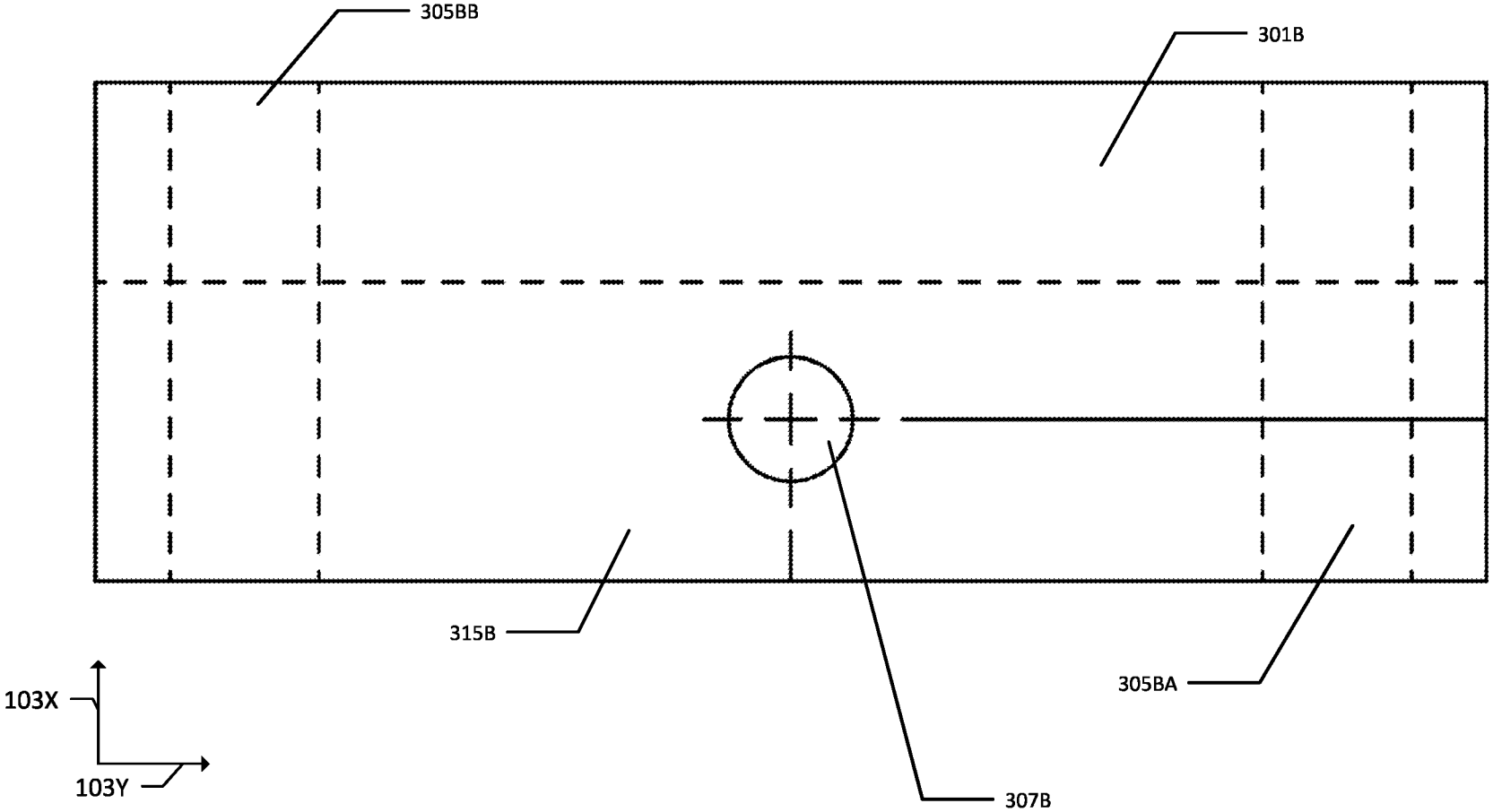
FIG. 3C is a planar view illustrating a wing clamp, as shown from a top perspective.

FIG. 3C is a planar view illustrating the wing clamp 301B, as shown from a top perspective. The hole 307B is facing toward the viewer, along the axis 103Z. The slotted holes 305BA. 305BB are oriented in parallel to the axis 103X.

Figure 3D:
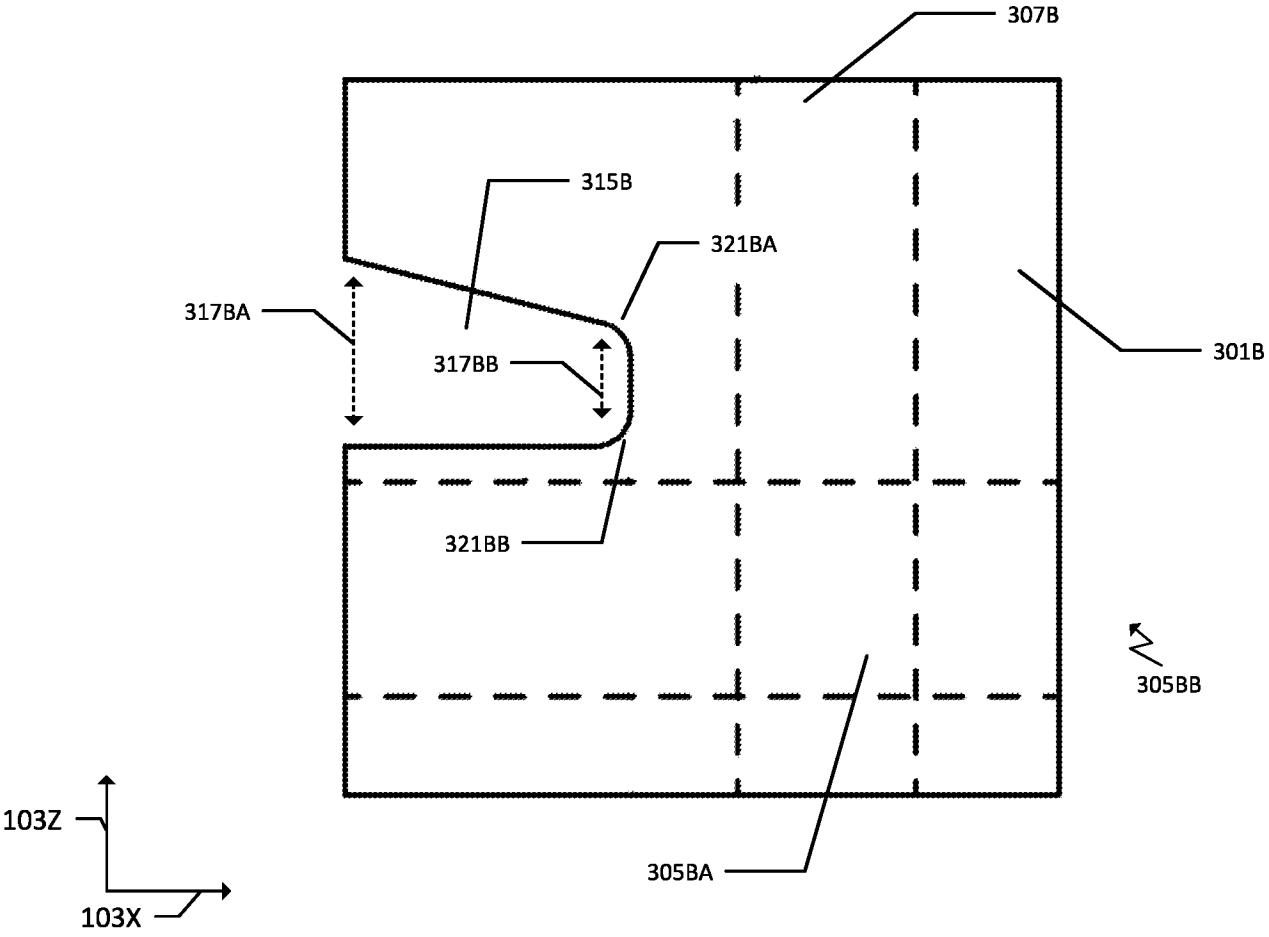
FIG. 3D is a planar view illustrating a wing clamp, as shown from a rear perspective.

FIG. 3D is a planar view illustrating the wing clamp 301B, as shown from a rear perspective. The rail receiver 315B comprises a first curved section 321BA and a second curved section 321BB. Similarly, the wing clamp 301A comprises a first curved section 321AA and a second curved section 321AB (both not shown in the instant view). The curved sections 321BA, 321BB are configured to provide substantial contact with the rail with which the wing clamp 301B is in contact. In general, more surface contact with the rail is desirable in order to increase connection and stability. One of skill in the art will appreciate that the wing clamps 301A. 301B may not comprise curved sections if the rail profile has other shapes (e.g., a rectangular shape comprising no curved sections).

A distance 317BA and a distance 317BB are present to provide fitment with the base of a rail against which the wing clamp 301B fits. Similarly, the wing clamp 305A comprises a first distance 317AA and second distance 317BA-again to accommodate fitment with the rail.

Figure 4A:
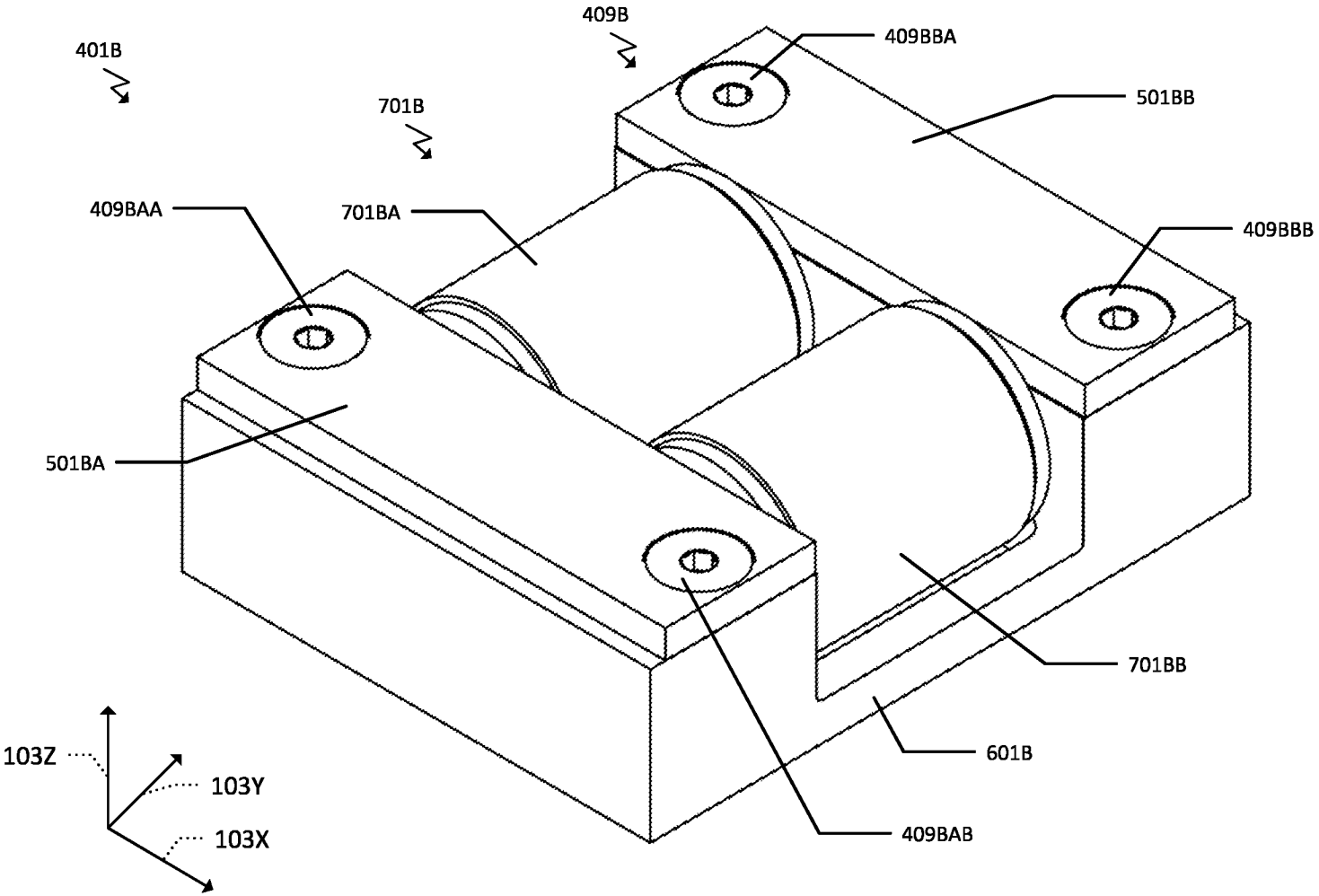
FIG. 4A is a perspective view illustrating a roller block assembly, as shown from a three-quarter perspective.

FIG. 4A is a perspective view illustrating the roller block assembly 401B, as shown from a three-quarter perspective. The roller block assembly 401B provides support for the moveable point of a moveable point frog. The roller block assembly 401B comprises a roller retainer body 601B. The roller retainer body 601B is configured to support a plurality of roller assemblies 701B which is, in turn, comprised of a first roller assembly 701BA and a second roller assembly 701BB.

The plurality of roller assemblies 701B is held in position via a first roller axle retainer 501BA and a second roller axle retainer 501BB. The roller axle retainer 501BA is fixed in position via a first hex screw 409BAA and a second hex screw 409BAB. Likewise, the roller axle retainer 501BB is fixed in position via a first hex screw 409BBA and a second hex screw 409BBB. A plurality of hex screws 409B is thus formed by the hex screws 409BAA, 409BAB, 409BBA, 409BBB. The plurality of hex screws 409B is installed substantially at or below a dorsal surface of the roller axle retainers 501BA, 501BB.

Figure 4B:
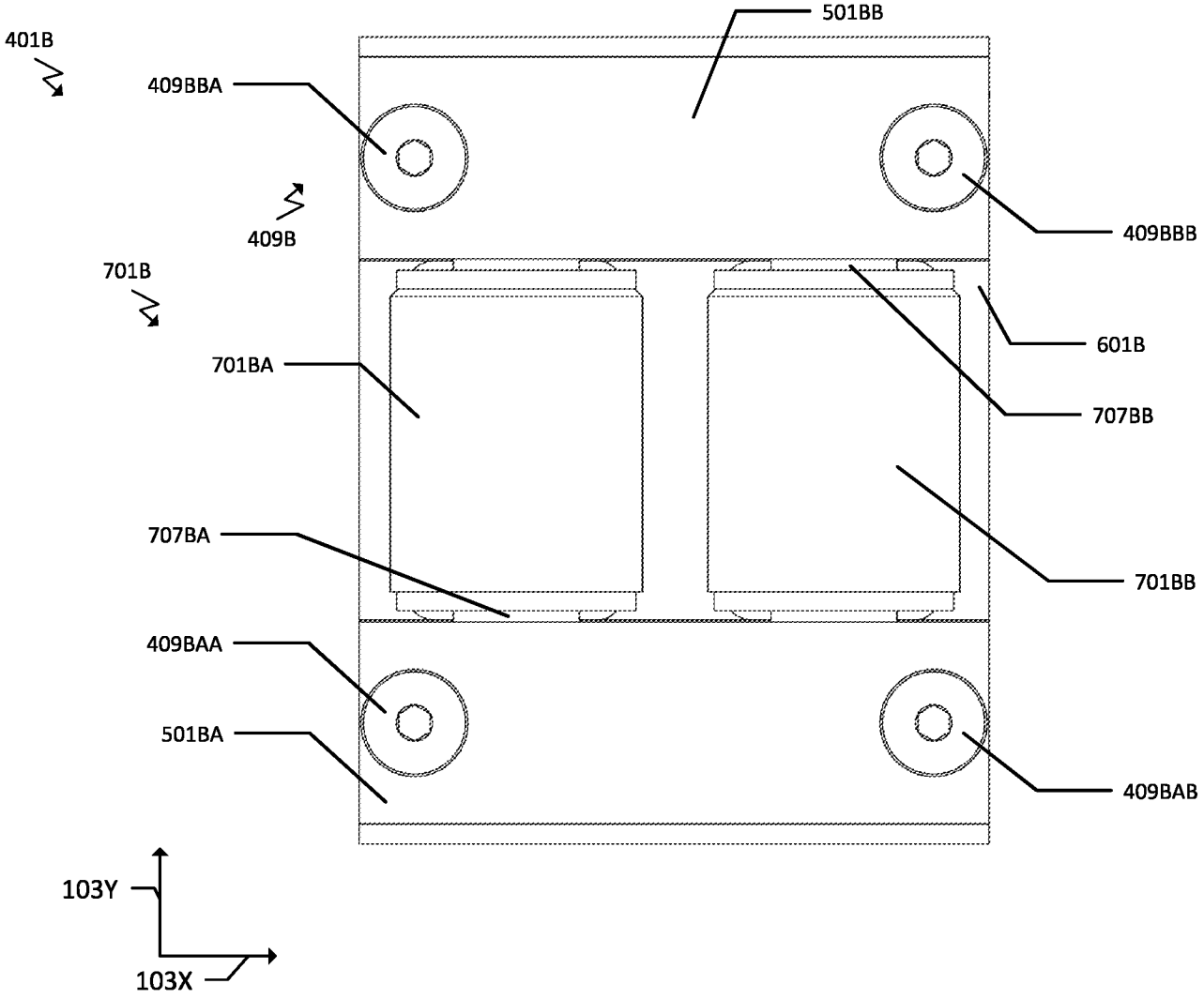
FIG. 4B is a planar view illustrating a roller block assembly, as shown from a top perspective.

FIG. 4B is a planar view illustrating the roller block assembly 401B, as shown from a top perspective. The instant view shows a first roller axle 707BA as part of the roller assembly 701BA. Similarly, a second roller axle 707BB is shown as part of the roller assembly 701BB. The roller axles 707BA, 707BB are configured such that the roller body 601B and the roller axle retainers 501BA, 501BB hold the roller axles 707BA, 707BB in position.

Figure 4C:
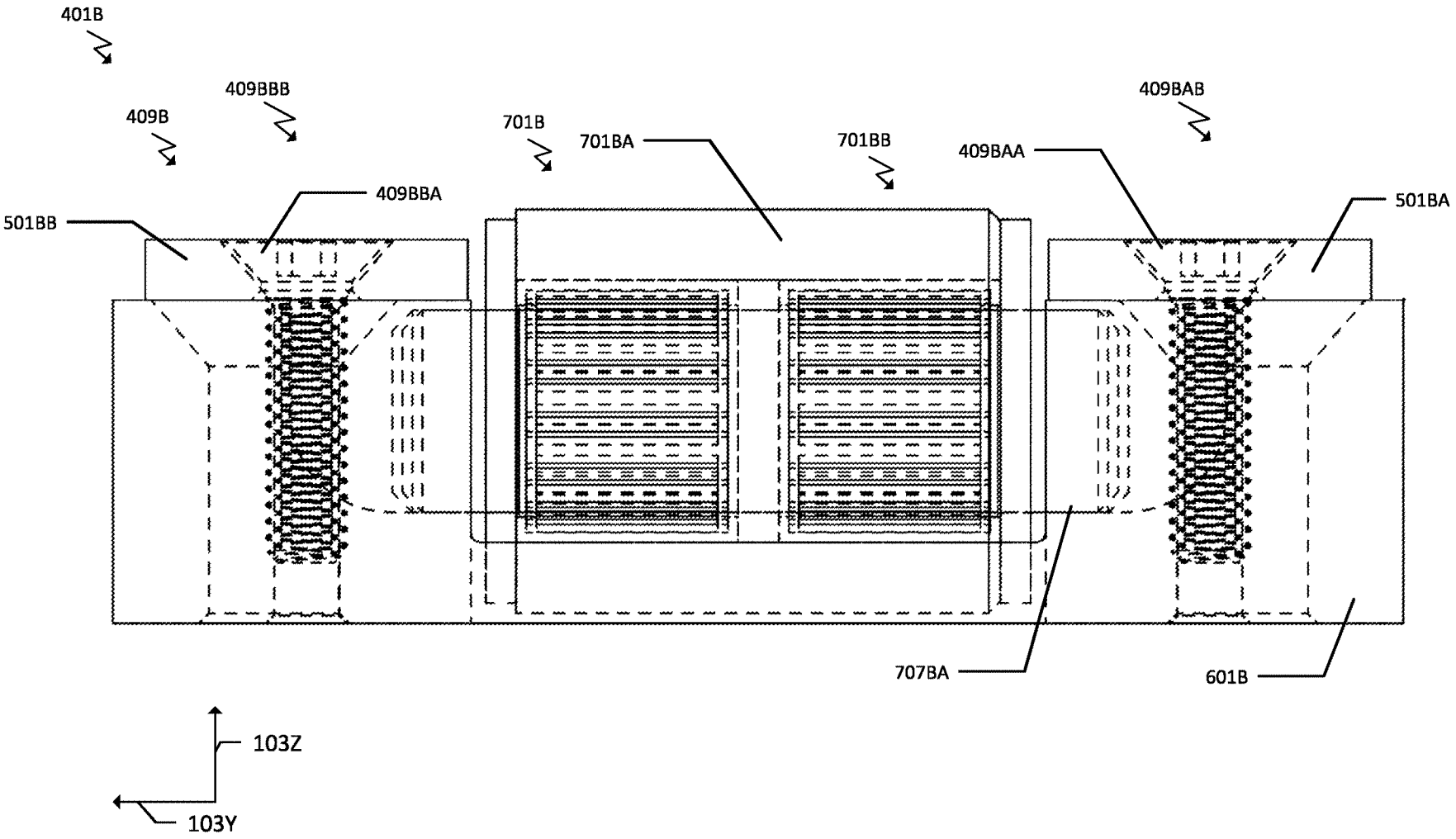
FIG. 4C is a planar view illustrating a roller block assembly, as shown from a side perspective.

FIG. 4C is a planar view illustrating the roller assembly 401B, as shown from a side perspective. The roller axle 707BA is shown in more detail in the instant view. Further, the plurality of hex screws 409B is shown as being substantially flush with the roller axle retainers 501BA, 501BB, e.g., at or below a dorsal surface of the roller axle retainers 501BA, 501BB. The plurality of roller assemblies 701B extend slightly above the roller axle retainers 501BA, 501BB such that the moveable point avoids contact with the roller axle retainers 501BA, 501BB. Thus, reduced friction of the moveable point is achieved.

Figure 5A:
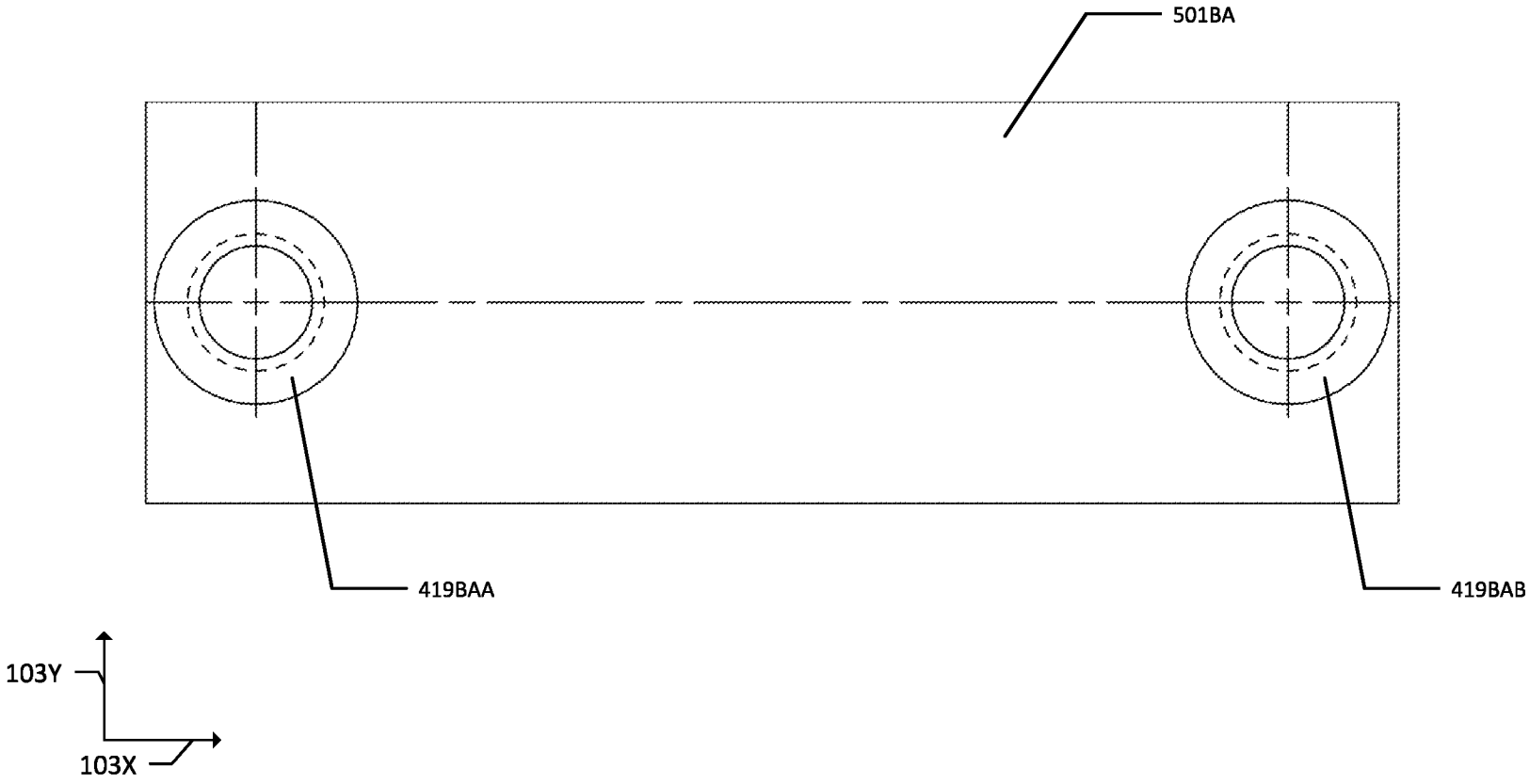
FIG. 5A is a planar view illustrating a roller axle retainer, as shown from a top perspective.

FIG. 5A is a planar view illustrating the roller axle retainer 501BA, as shown from a top perspective. The instant view shows a first hole 419BAA and a second hole 419BAB, both of which are disposed in the roller axle retainer 501BA. The holes 419BAA, 419BAB are configured such that the plurality of hex screws 409B may be at or below a dorsal surface of the roller axle retainer 501BA, thus preventing the moveable point from interfering with the moveable point frog friction-reducing assembly 101.

Figure 5B:
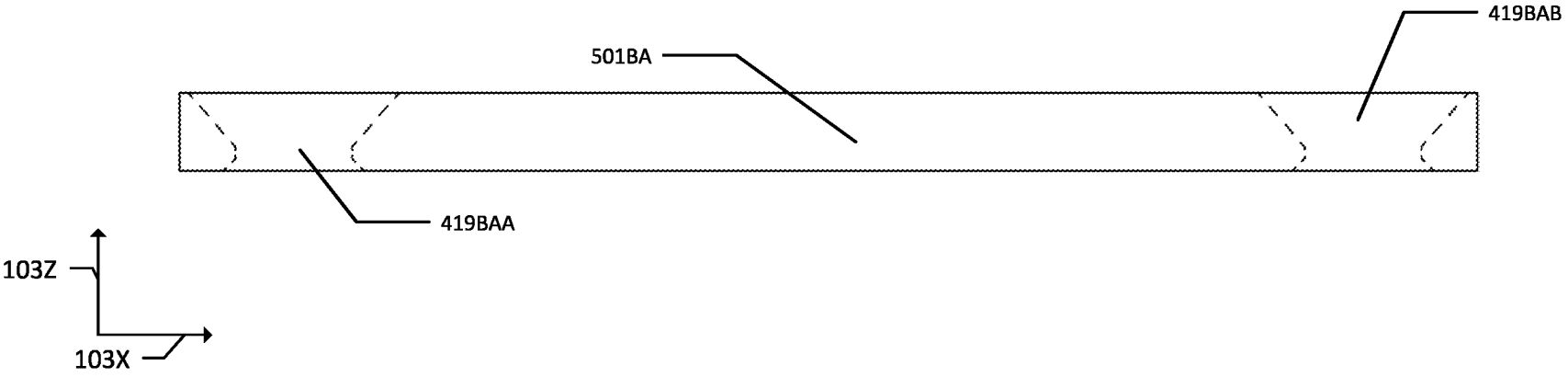
FIG. 5B is a planar view illustrating a roller axle retainer, as shown from a side perspective.

FIG. 5B is a planar view illustrating the roller axle retainer 501BA, as shown from a side perspective. One of skill in the art will appreciate that the holes 419BAA, 419BAB are configured to enable interference-free movement of a moveable point.

Figure 6A:
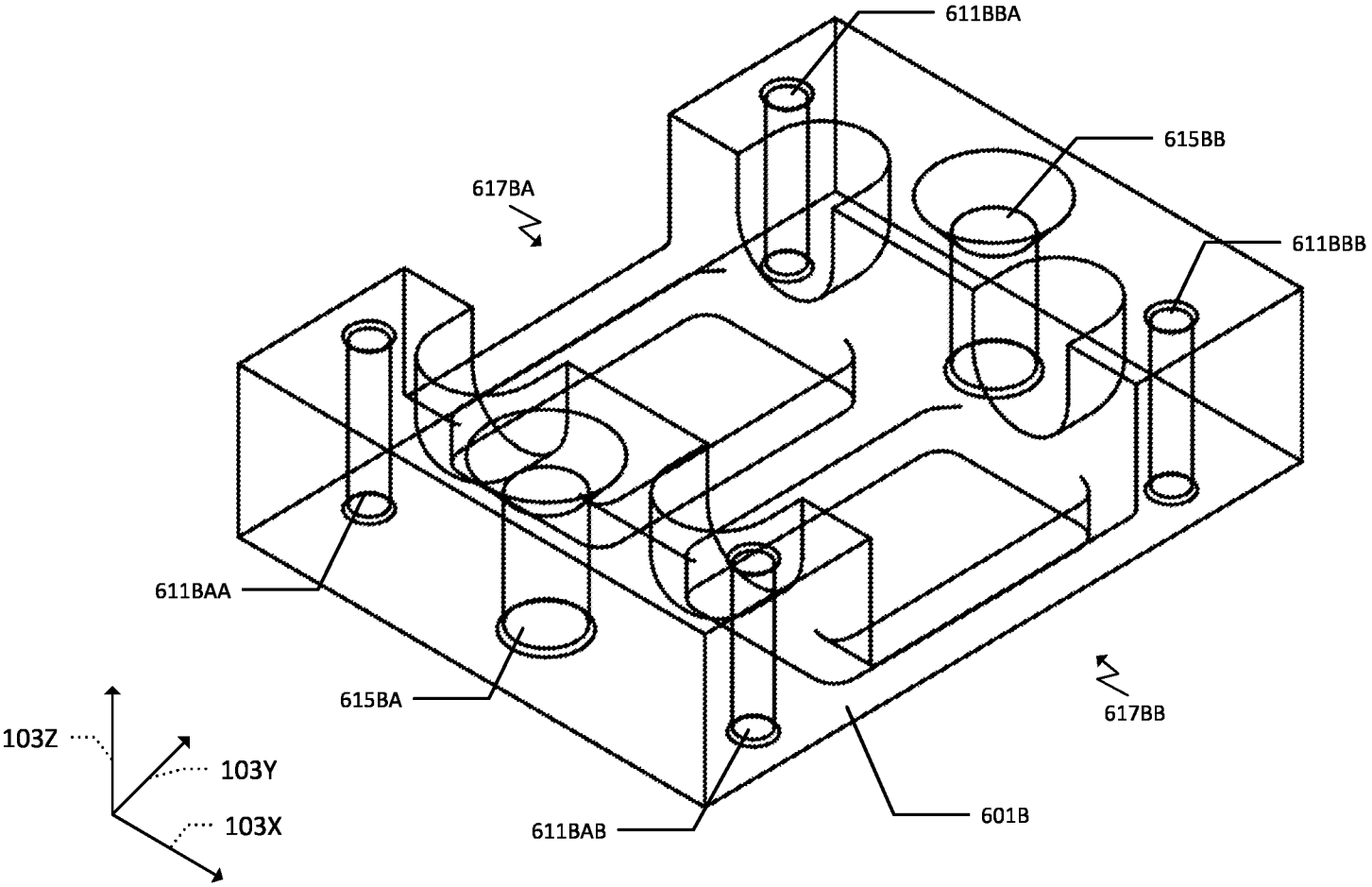
FIG. 6A is a perspective view illustrating a roller retainer body, as shown from a three-quarters perspective.

FIG. 6A is a perspective view illustrating the roller retainer body 601B, as shown from a three-quarters perspective. The roller retainer body 601B comprises a first roller assembly retainer 617BA and a second roller assembly retainer 617BB. The roller assembly retainers 617BA, 617BB are configured such that the plurality of roller assemblies 701B may be held in place via the roller axles 707BA, 707BB. One of skill in the art will appreciate that the roller assembly retainers 617BA, 617BB comprise an opening on the ventral surface that enables free movement of the roller assemblies 701BA, 701BB about the roller axles 707BA, 707BB. Thus, the moving faces of the plurality of roller assemblies 701B avoid contact with the roller retainer body 601B.

The roller retainer body 601B further comprises a first hole 611BAA, a second hole 611BAB, a third hole 611BBA, and a fourth hole 611BBB. The holes 611BAA, 611BAB, 611BBA, 611BBB enable the plurality of hex screws 409B to be threaded into the roller retainer body 601B. The plurality of hex screws 409B provides attachment of the roller axle retainers 501AB, 501BB.

The roller retainer body 601B further comprises a first hole 615BA and a second hole 615BB. The holes 615BA, 615BB enable the roller assembly block 401B to be affixed to the base plate assembly 201. One of skill in the art will appreciate that the holes 615BA, 615BB are configured such that a screw may be installed at or below a ventral face of the roller axle retainers 501BA, 501BB, thus enabling tight fitment of the roller axle retainers 501BA, 501BB against the roller retainer body 601B. The holes 615BA, 615BB are configured to be aligned with the pluralities of holes 213A, 213B within the base plate assembly 201. Specifically, the hole 615BA is aligned with the plurality of holes 213A, and the hole 615BB is aligned with the plurality of holes 213B. Therefore, the roller retainer body 601B may be positioned along the axis 103X of the base plate assembly 201.

Figure 6B:
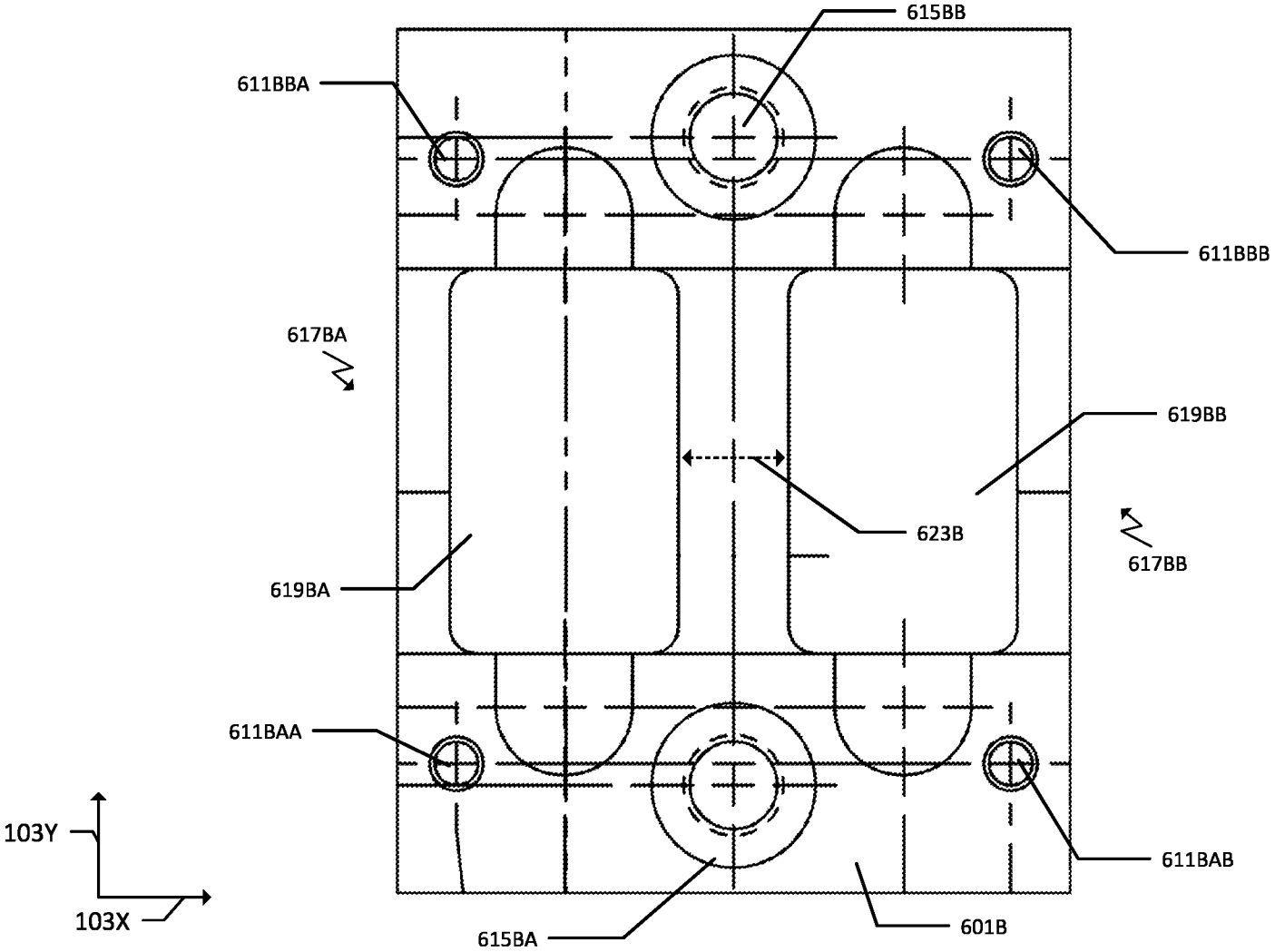
FIG. 6B is a planar view illustrating a roller retainer body, as shown from a top perspective.

FIG. 6B is a planar view illustrating the roller retainer body 601B, as shown from a top perspective. The roller retainer body 601B further comprises a first hole 619BA and a second hole 619BB to enable the free movement of the plurality of roller assemblies 701B. In the instant view, a distance 623B is shown between the holes 619BA, 619BB to highlight that the plurality of roller assemblies 701B may be distanced such that the roller assemblies 701BA, 701BB may freely rotate without contact between one another.

Figure 6C:
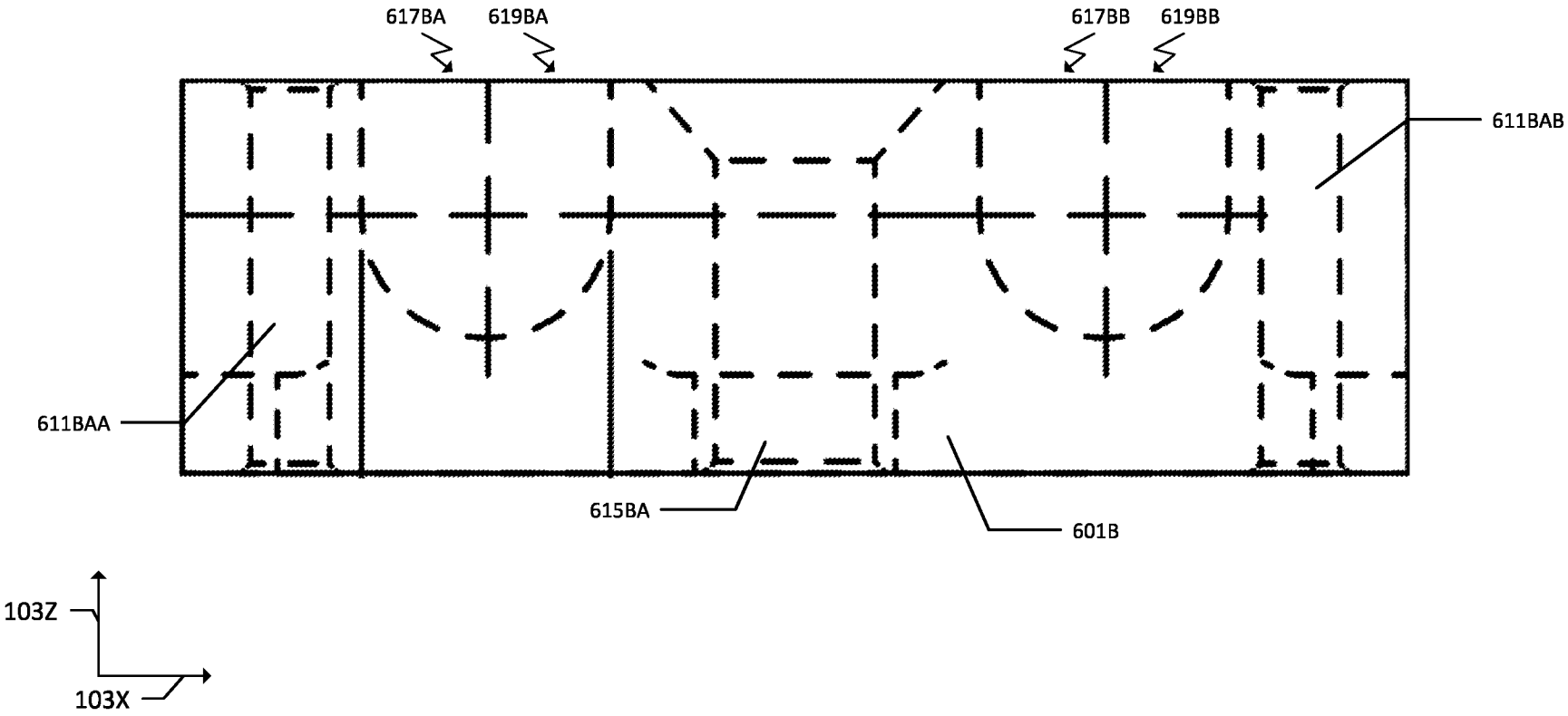
FIG. 6C is a planar view illustrating a roller retainer body, as shown from a rear perspective.

FIG. 6C is a planar view illustrating the roller retainer body 601B, as shown from a rear perspective. The instant view clearly shows the hole 615BA (and the hole 615BB) as being configured to enable the flush mounting of the roller axle retainers 501BA, 501BB. The flush mounting provides for locking tension with any screws passing through the holes 615BA, 615BB due to the pressure created by the roller axle retainers 501BA, 501BB, respectively.

Figure 6D:
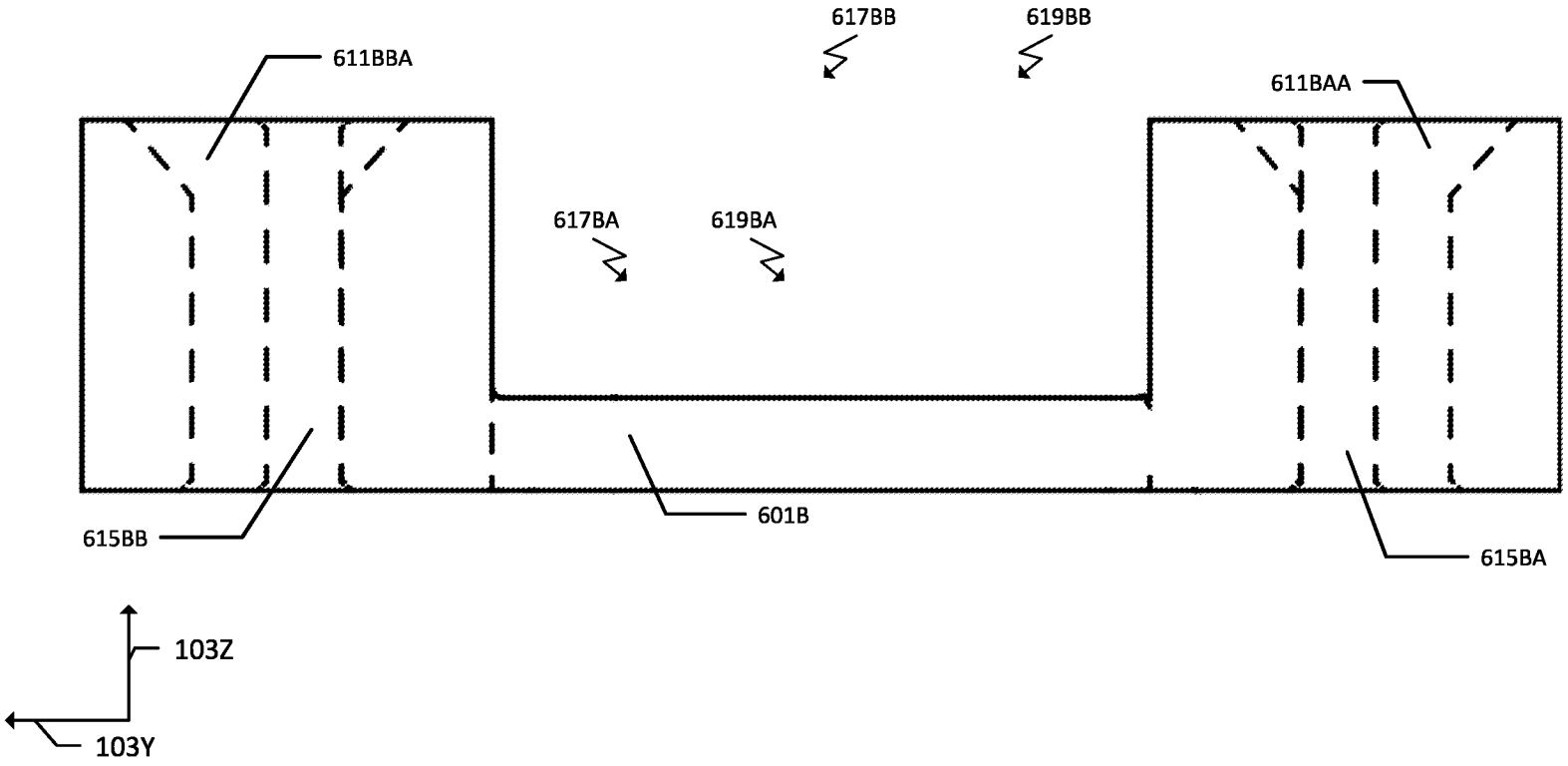
FIG. 6D is a planar view illustrating a roller retainer body, as shown from a side perspective.

FIG. 6D is a planar view illustrating the roller retainer body 601B, as shown from a side perspective. The instant view highlights that the roller assemblies 701BA, 701BB may freely rotate about the axis 103Y without contacting the space lateral to the roller retainer body 601B.

Figure 7A:
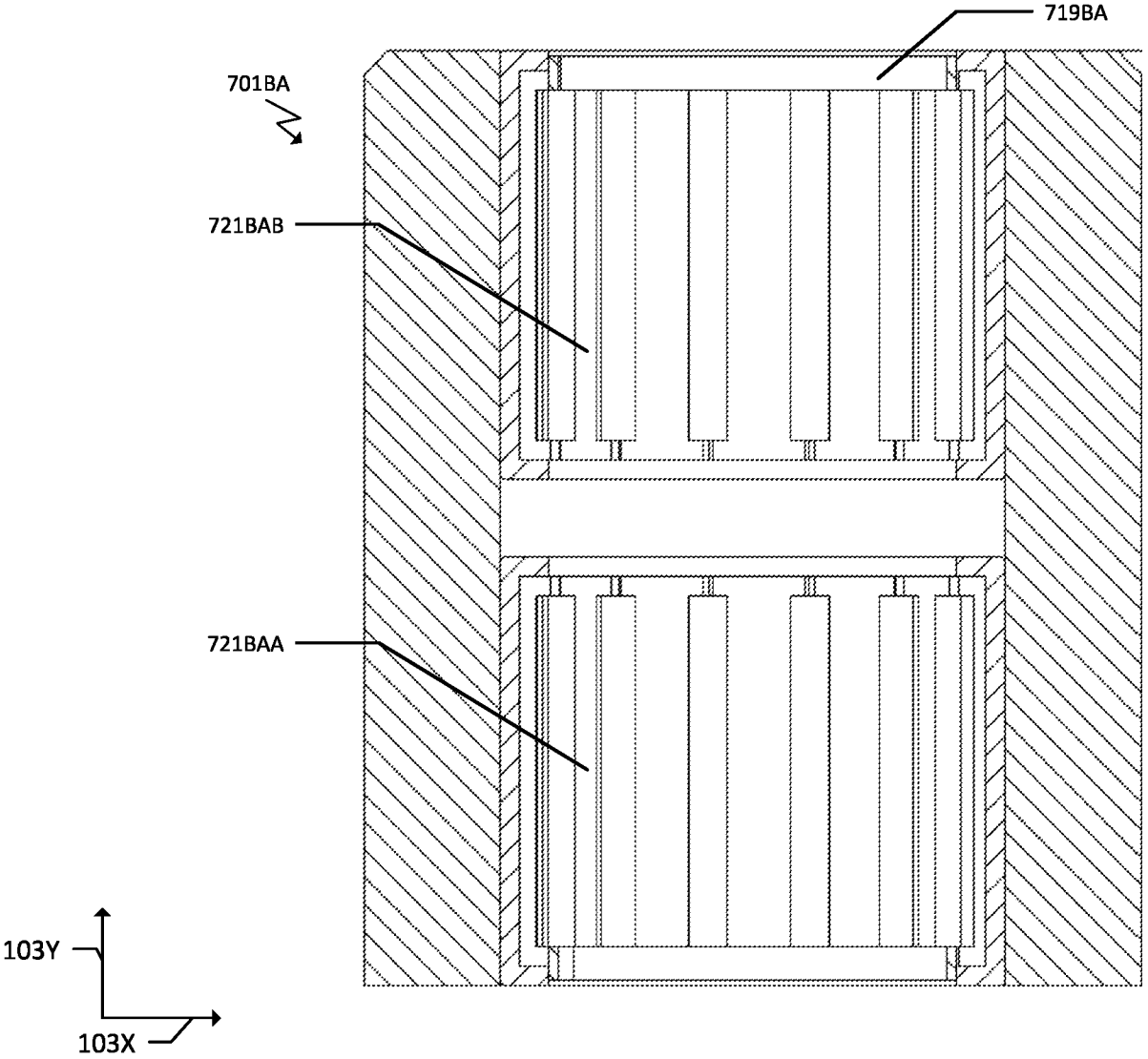
FIG. 7A is a planar view illustrating a roller assembly, as shown from a top perspective.

FIG. 7A is a planar view illustrating the roller assembly 701BA, as shown from a top perspective. The roller axle 707BA is removed from the instant view to provide further detail to the viewer. A bushing 719BA is disposed along the axis 103Y in order to accommodate rotation about the roller axle 707BA. The roller assembly 701BA comprises a first plurality of needle roller bearings 721BAA and a second plurality of needle roller bearings 721BAB. The needle roller bearings 721BAA, 721BAB provide reduced-friction rotation about the bushing 719BA.

Figure 7B:
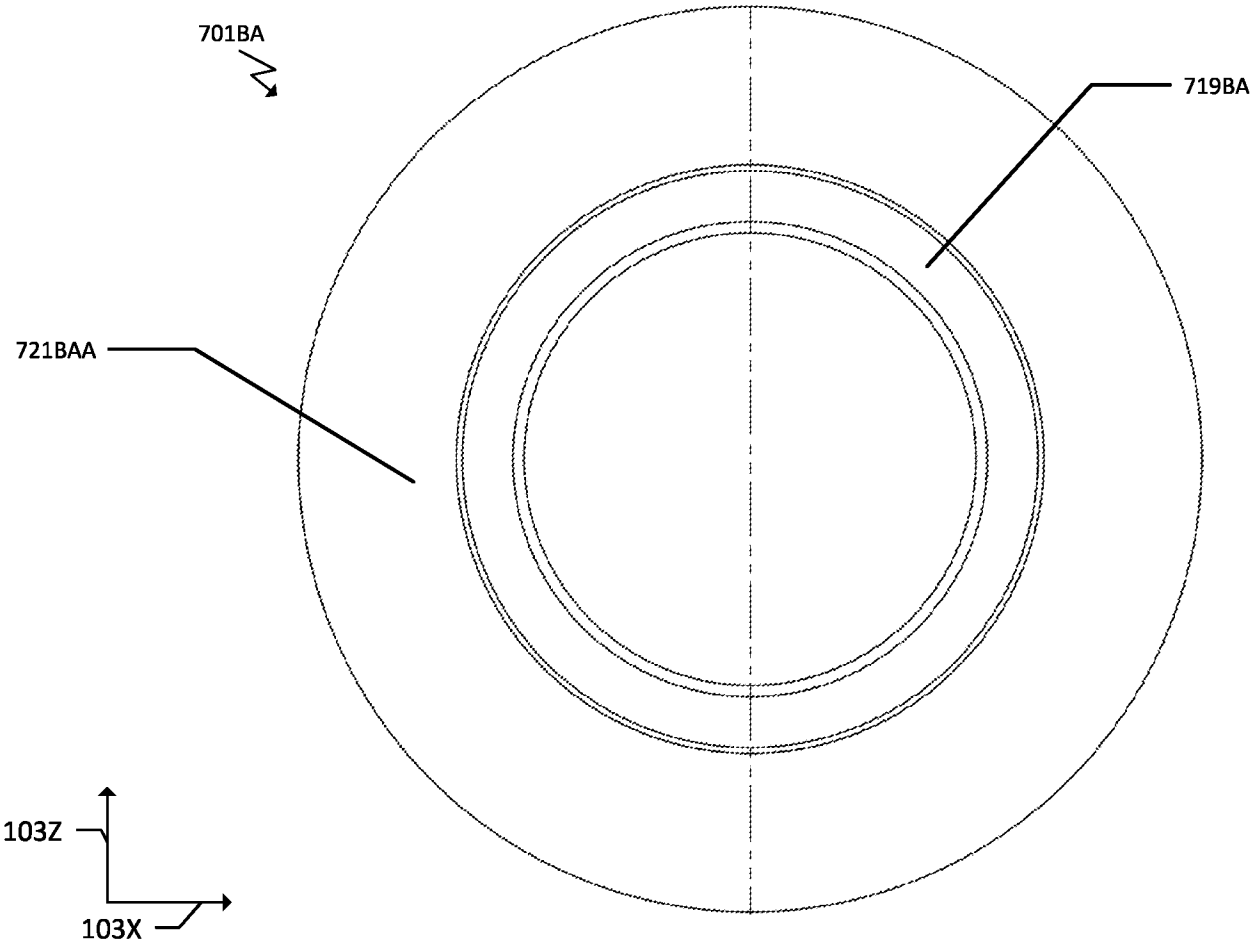
FIG. 7B is a planar view illustrating a roller assembly, as shown from a side perspective.

FIG. 7B is a planar view illustrating the roller assembly 701BA, as shown from a side perspective. The instant view more clearly shows the bushing 719BA in relation to the needle roller bearing 721BAA.

Figure 7C:
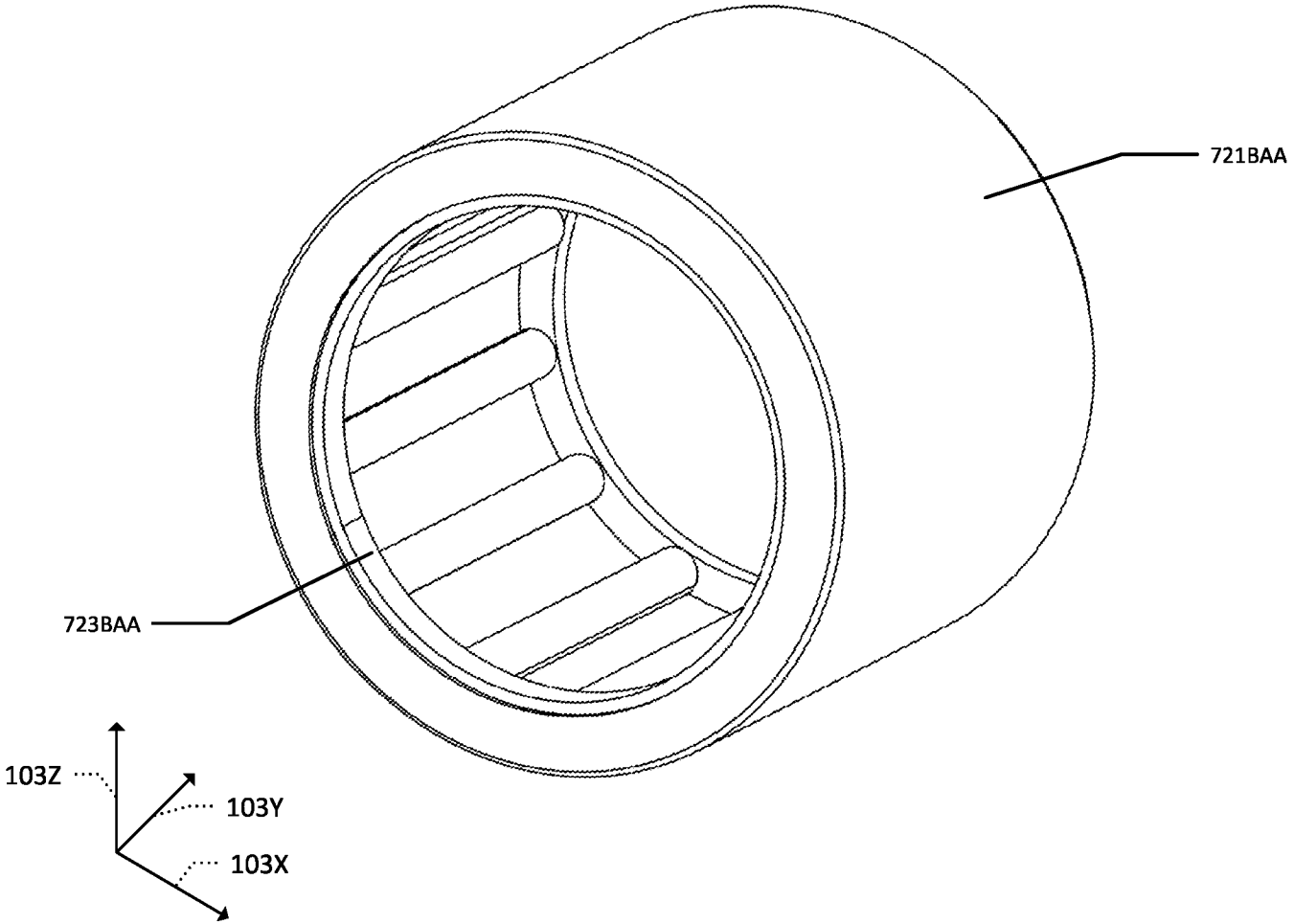
FIG. 7C is a perspective view illustrating a needle roller bearing, as shown from a three-quarters perspective.

FIG. 7C is a perspective view illustrating the needle roller bearing 721BAA, as shown from a three-quarters perspective. The roller needle bearing 721BAA comprises a bearing seal 723BAA which seals the needle roller bearing 721BAA.

Figure 8A:
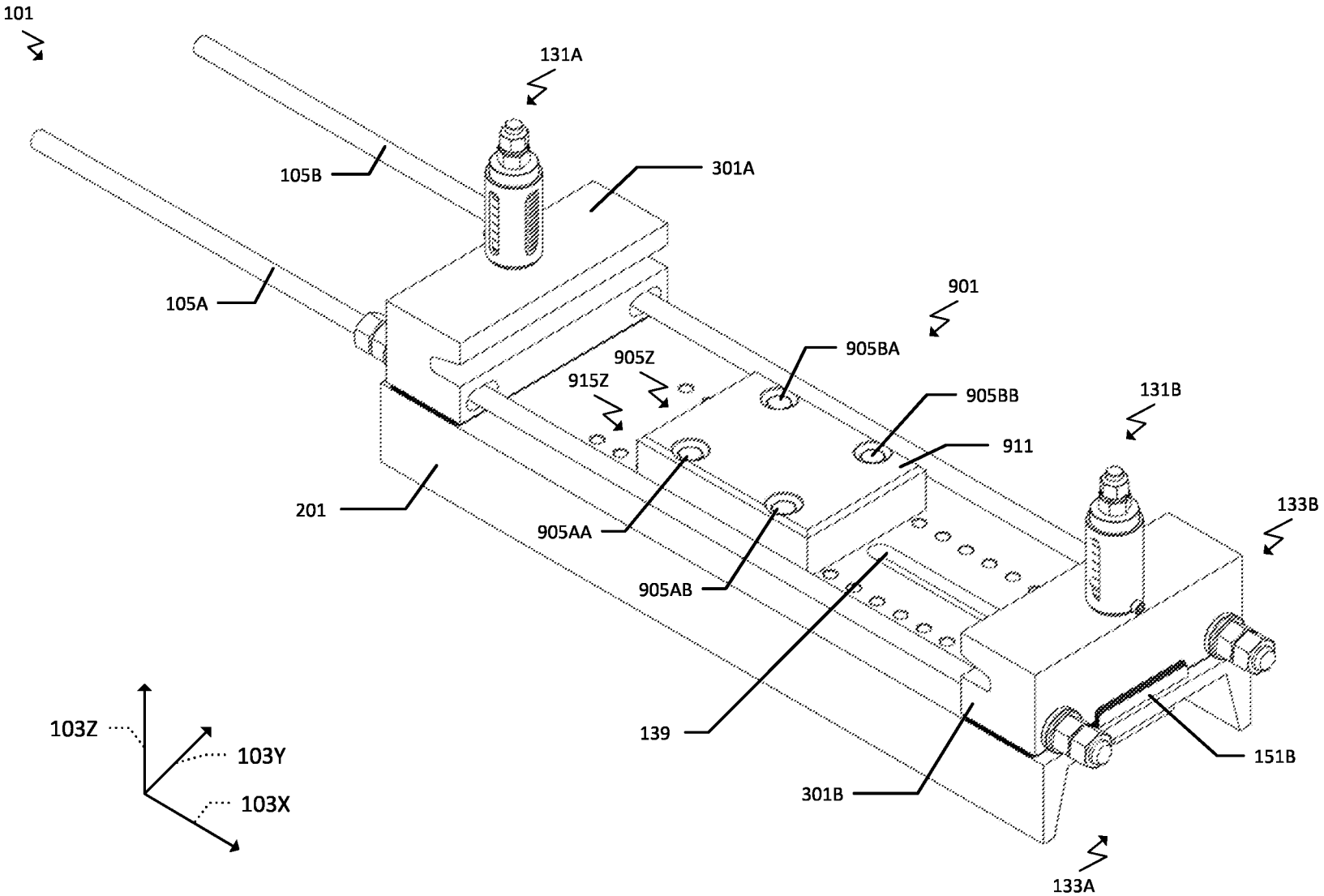
FIG. 8A is a perspective view illustrating a moveable point frog friction-reducing assembly, as shown from a three-quarters perspective.

FIG. 8A is a perspective view illustrating the moveable point frog friction-reducing assembly 101, as shown from a three-quarters perspective. The instant view depicts an alternative configuration of the moveable point frog friction-reducing assembly 101 which is configured to use a sliding assembly 901 as the friction-reducing assembly. Stated differently, the sliding assembly 901 is utilized in lieu of the roller block assemblies 401A, 401B in order to provide reduced-friction for the transitions of the moveable point.

The sliding assembly 901 comprises the slide block 911. The slide block 911 may be formed from ultra-high molecular weight polyethylene ("UHMWPE"), high-density polyethylene ("HDPE"), low-density polyethylene ("LDPE"), polytetrafluoroethylene ("PTFE"), Delrin ("acetal plastic"), or a combination thereof, in one aspect. In one aspect, the coefficient of friction of the slide block 911 enables the movement of the moveable point to be substantially similar to that of the roller block assemblies 401A, 401B.

One advantage of the slide block 911 is durability while still providing the necessary coefficient of friction. In particular, UHMWPE is a relatively inexpensive material that can be deployed at lower cost than other similar materials. One of skill in the art will appreciate that the material used has a lower coefficient of friction than that of steel (of which the moveable point is often comprised).

The sliding assembly 901 is configured to be attached to the base plate assembly 201 via a plurality of holes 915Z and a plurality of hex bolts 905Z. The plurality of hex bolts 905Z is comprised of a first hex bolt 905AA, a second hex bolt 905AB, a third hex bolt 905BA, and a fourth hex bolt 905BB. On the ventral side, a plurality of nuts 907Z (not shown in the instant view) is utilized to respectively fix the plurality of hex bolts 905Z to the base plate assembly 201.

Figure 8B:
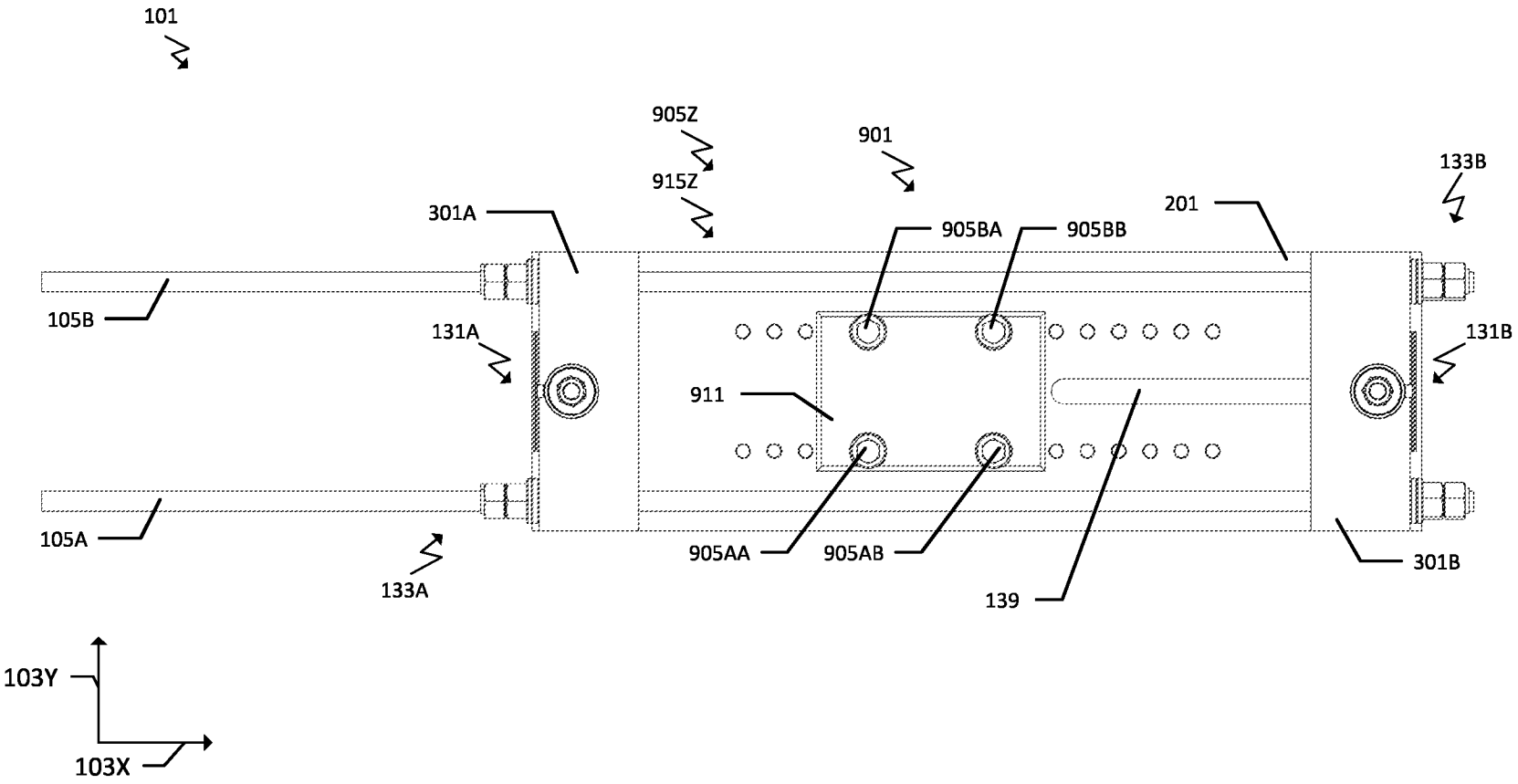
FIG. 8B is a planar view illustrating a moveable point frog friction-reducing assembly, as shown from a top perspective.

FIG. 8B is a planar view illustrating the moveable point frog friction-reducing assembly 101, as shown from a top perspective. The plurality of hex bolts 905Z is flush or below the dorsal surface of the slide block 911 because the plurality of holes 915Z is counterbored. As such, the moveable point may transition with reduced friction while not interfering with the plurality of hex bolts 905Z.

Figure 8C:
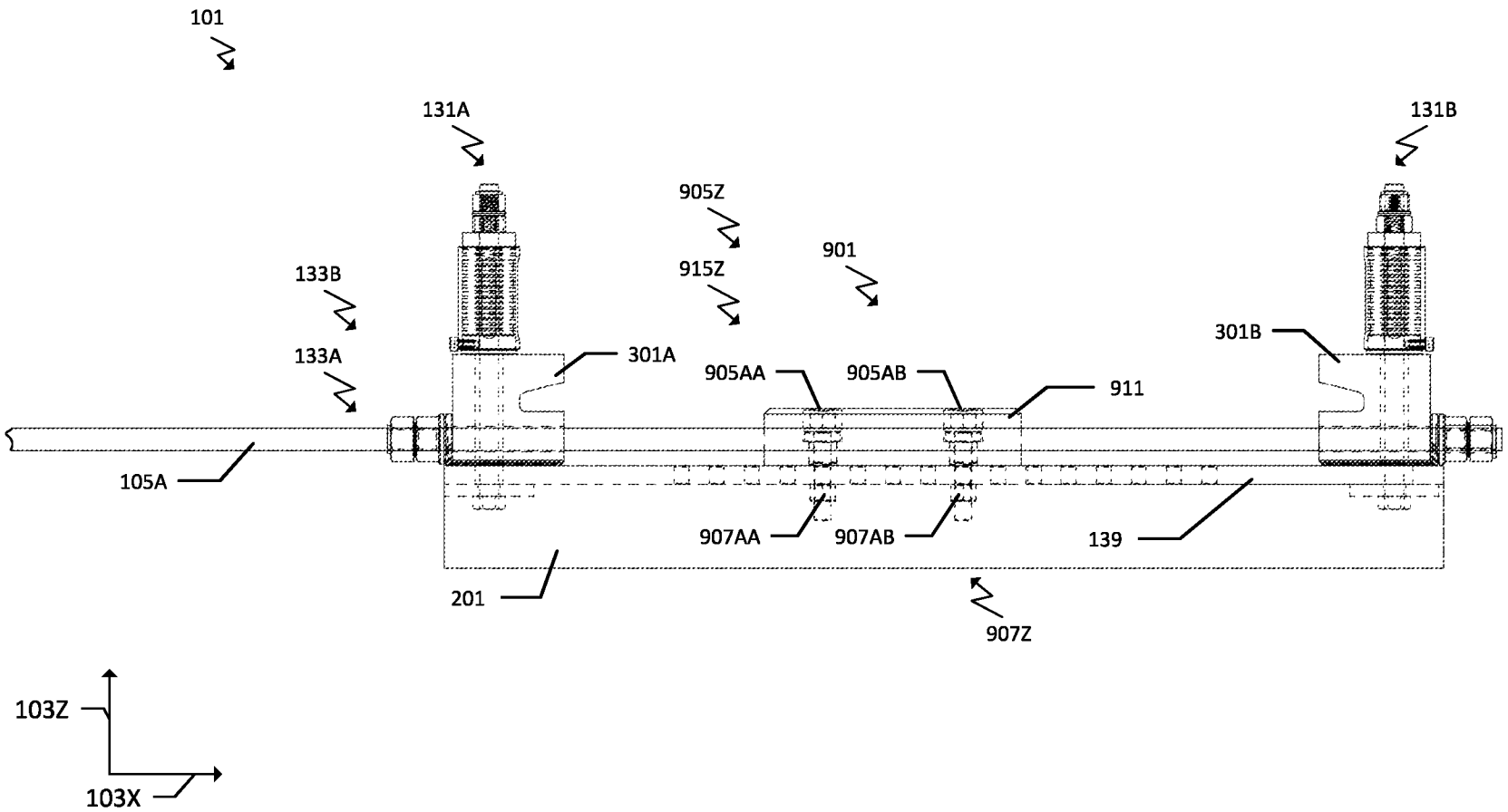
FIG. 8C is a planar view illustrating a moveable point frog friction-reducing assembly, as shown from a rear perspective.

FIG. 8C is a planar view illustrating the moveable point frog friction-reducing assembly 101, as shown from a rear perspective. The instant view shows the plurality of nuts 907Z more clearly. Specifically, the hex bolt 905AA is fixed in position via a first nut 907AA. Likewise, the hex bolt 905AB is fixed in position via a second nut 907AB.

Figure 8D:
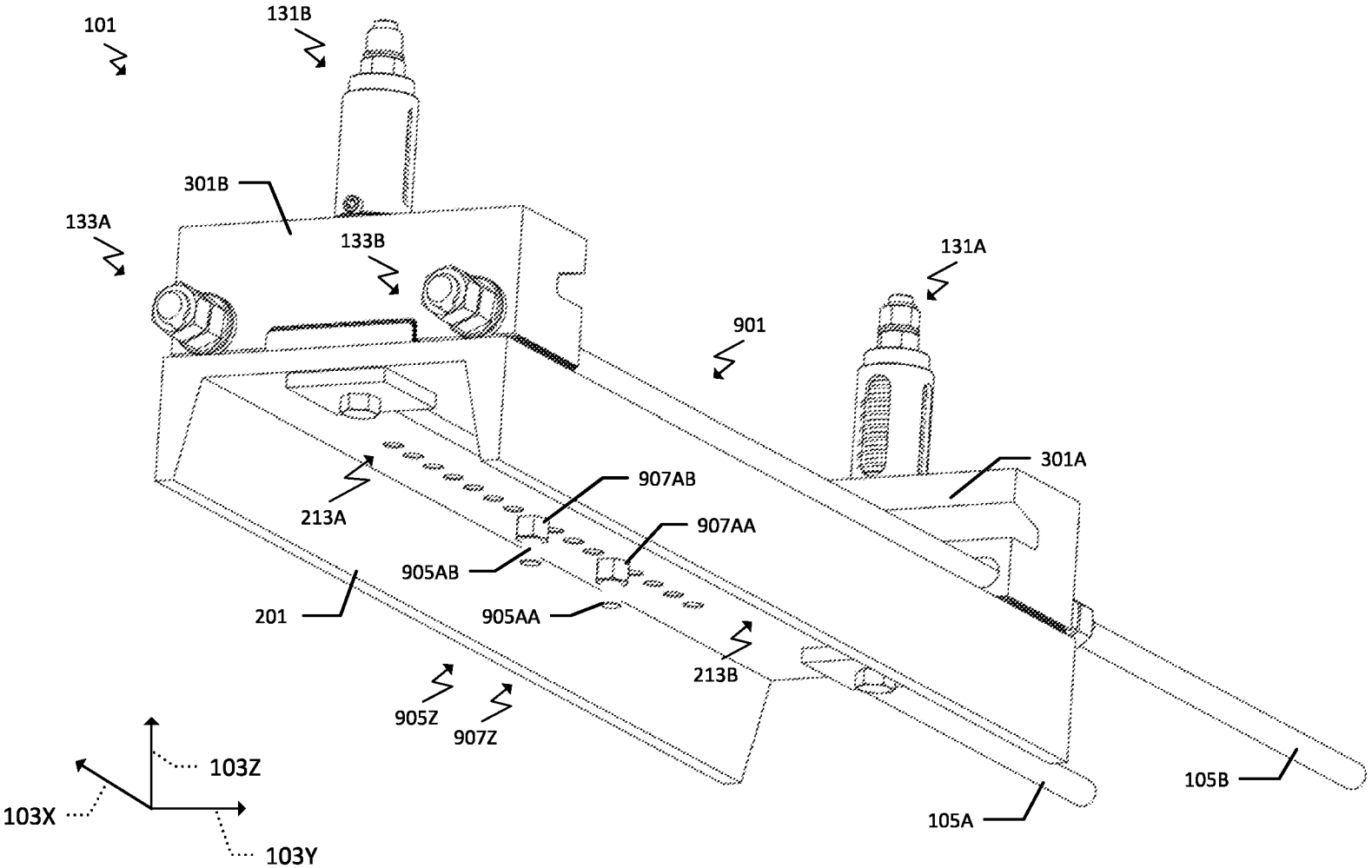
FIG. 8D is a perspective view illustrating a moveable point frog friction-reducing assembly, as shown from a three-quarters perspective.

FIG. 8D is a perspective view illustrating the moveable point frog friction-reducing assembly 101, as shown from a three-quarters perspective. The hex bolts 905AA, 905AB are shown penetrating through the ventral surface of the base plate assembly 201 via the plurality of holes 213A. Further, the nuts 907AA, 907AB fix the hex bolts 905AA, 905AB in position with respect to the base plate assembly 201.

Figure 9A:
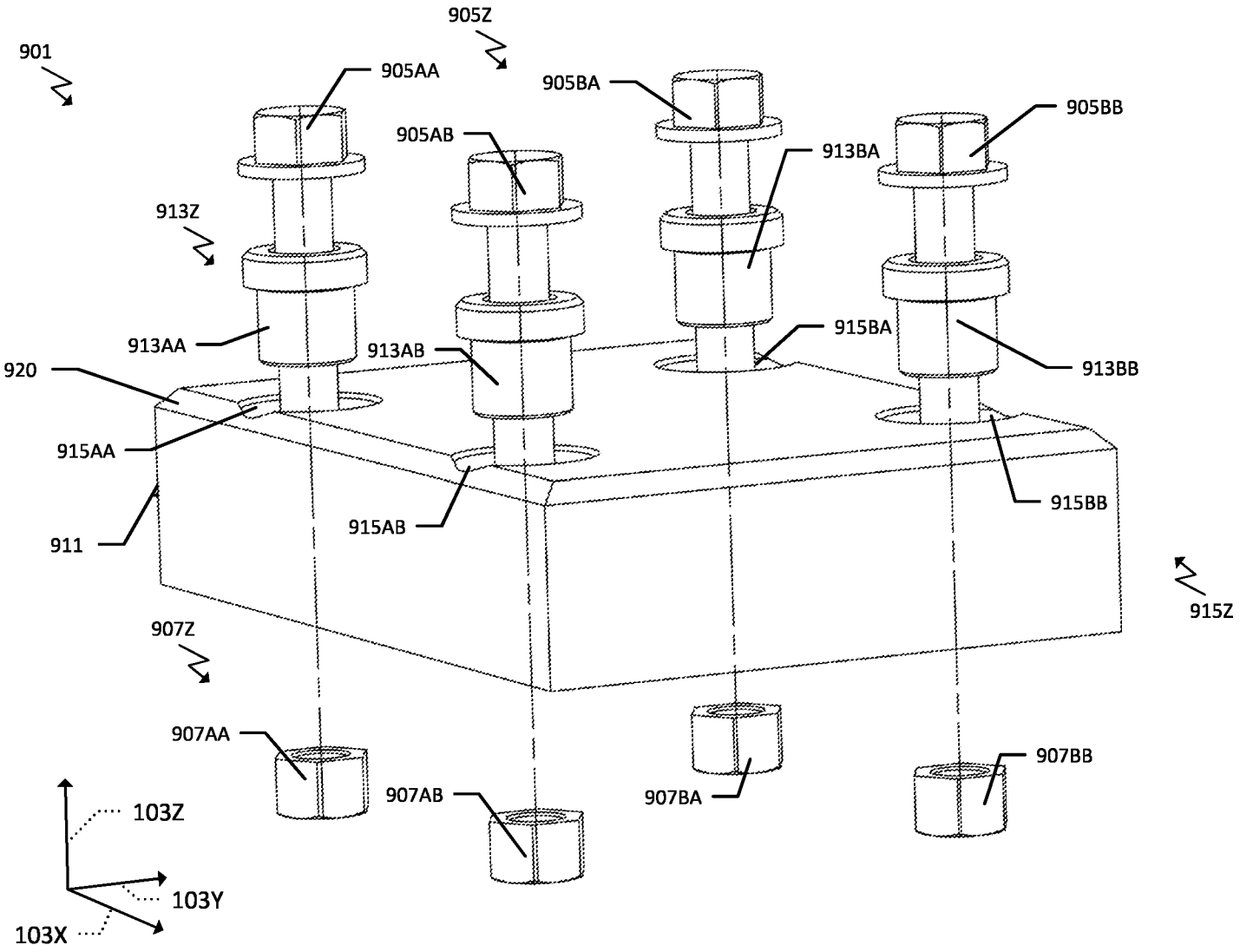
FIG. 9A is a perspective view illustrating a sliding assembly, as shown from a three-quarters perspective.

FIG. 9A is a perspective view illustrating the sliding assembly 901, as shown from a three-quarters perspective. As disclosed herein, the moveable point frog friction-reducing assembly 101 may rely on various types of friction-reducing assemblies. At FIG. 1A above, the friction-reducing assembly is a roller-based assembly, namely the roller block assemblies 401A, 401B. The instant view illustrates an alternative version of a friction-reducing assembly which uses a sliding block having a desirable coefficient of friction (e.g., less than that of steel).

The sliding assembly 901 is configured to being attached to the base plate assembly 201. In one aspect, the sliding assembly 901 is configured to being used in a similar manner as the roller block assemblies 401A, 401B.

The slide block 911 comprises a plurality of holes 915Z which is, in turn, comprised of a first hole 915AA, a second hole 915AB, a third hole 915BA, and a fourth hole 915BB. The plurality of holes 915Z enable the installation of the slide block 911 on a dorsal side of the base plate assembly 201. Specifically, the holes 915BA. 915BB are configured to be aligned with the plurality of holes 213B. Likewise, the holes 915AA, 915AB are configured to be aligned with the plurality of holes 213A.

A plurality of bushings 913Z is comprised of a first bushing 913AA, a second bushing 913AB, a third bushing 913BA, and a fourth bushing 913BB. The plurality of bushings 913Z is configured to be fitted into the plurality of holes 915Z. The plurality of bushings 913Z is configured such that a dorsal surface of the slide block 911 is free from interference by the plurality of bushings 913Z. Stated differently, the plurality of holes 915Z is configured such that the plurality of bushings 913Z is seated at or below a dorsal surface of the slide block 911. One of skill in the art will appreciate that having the plurality of bushings 913Z at or below the dorsal surface of the slide block 911 enables the movement of the moveable point without interference.

The plurality of hex bolts 905Z is configured to being installed into the plurality of bushings 913Z. At the ventral side of the base plate assembly 201, a plurality of nuts 907Z is utilized to fix the plurality of hex bolts 905Z in position. The plurality of nuts 907Z comprises the first nut 907AA, the second nut 907AB, a third nut 907BA, and a fourth nut 907BB. As with the roller block assemblies 401A, 401B, the sliding assembly 901 is configured to being secured via the ventral side of the base plate assembly 201. One of skill in the art will appreciate that washers, lock nuts, or a combination thereof may be utilized in addition to the plurality of nuts 907Z in order to secure the sliding assembly 901 in place.

A ramp 920 is present at a dorsal perimeter of the sliding block 911. The ramp 920 provides a deflection angle in the event that the moveable point approaches the slide block 911 at a lower angle than intended. For instance, the moveable point may approach the slide block 911 and then be deflected toward the dorsal surface of the slide block 911 without causing undesired interference with the slide block 911. As such, maintenance is reduced and safety is enhanced.

Figure 9B:
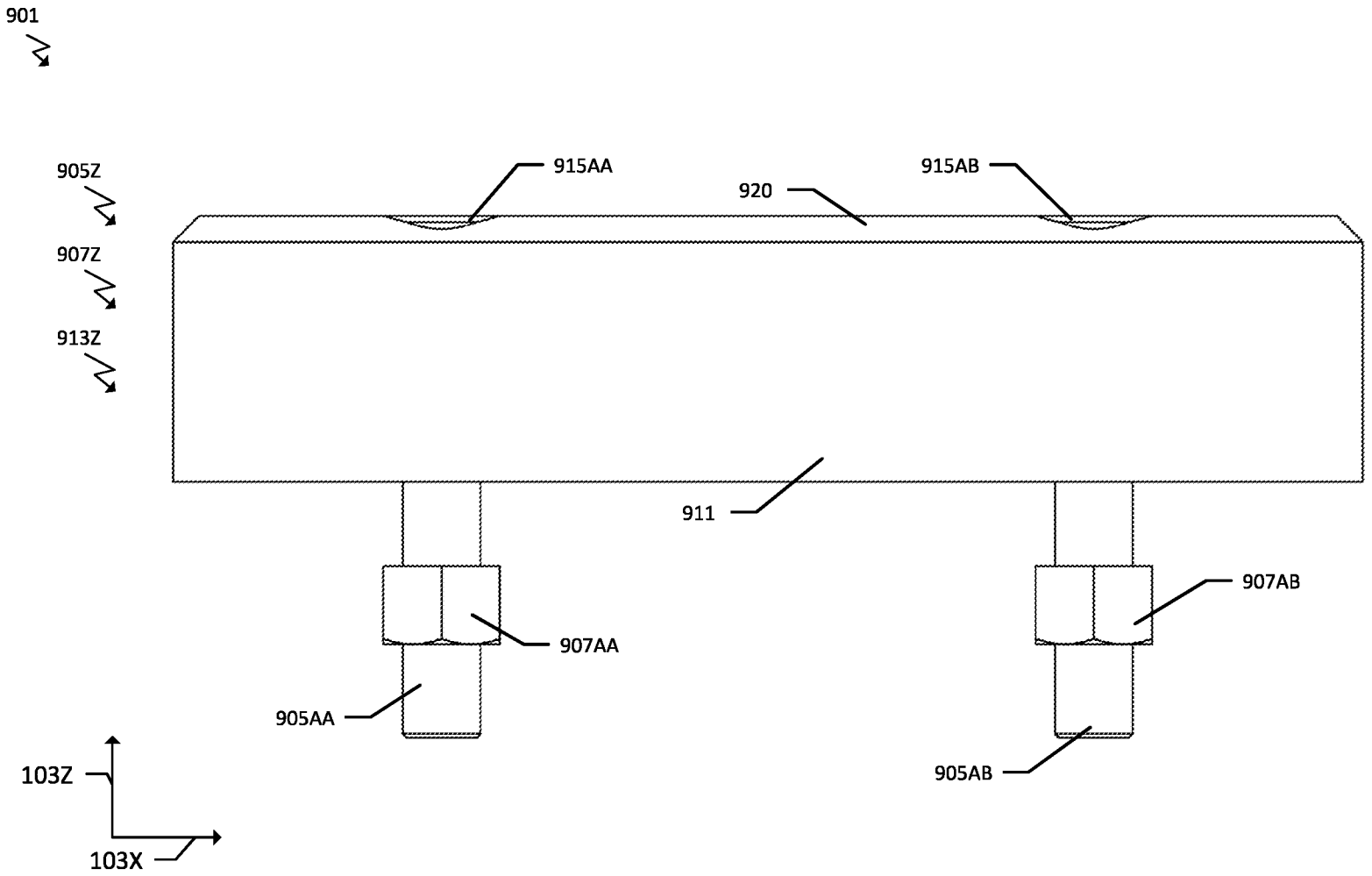
FIG. 9B is a planar view illustrating a sliding assembly, as shown from a side perspective.

FIG. 9B is a planar view illustrating the sliding assembly 901, as shown from a side perspective. The instant view illustrates the sliding assembly 901 as would be seen without the base plate assembly 201. Again, the base plate assembly 201 is configured to being disposed between the plurality of nuts 907Z and the ventral side of the slide block 911.

Figure 9C:
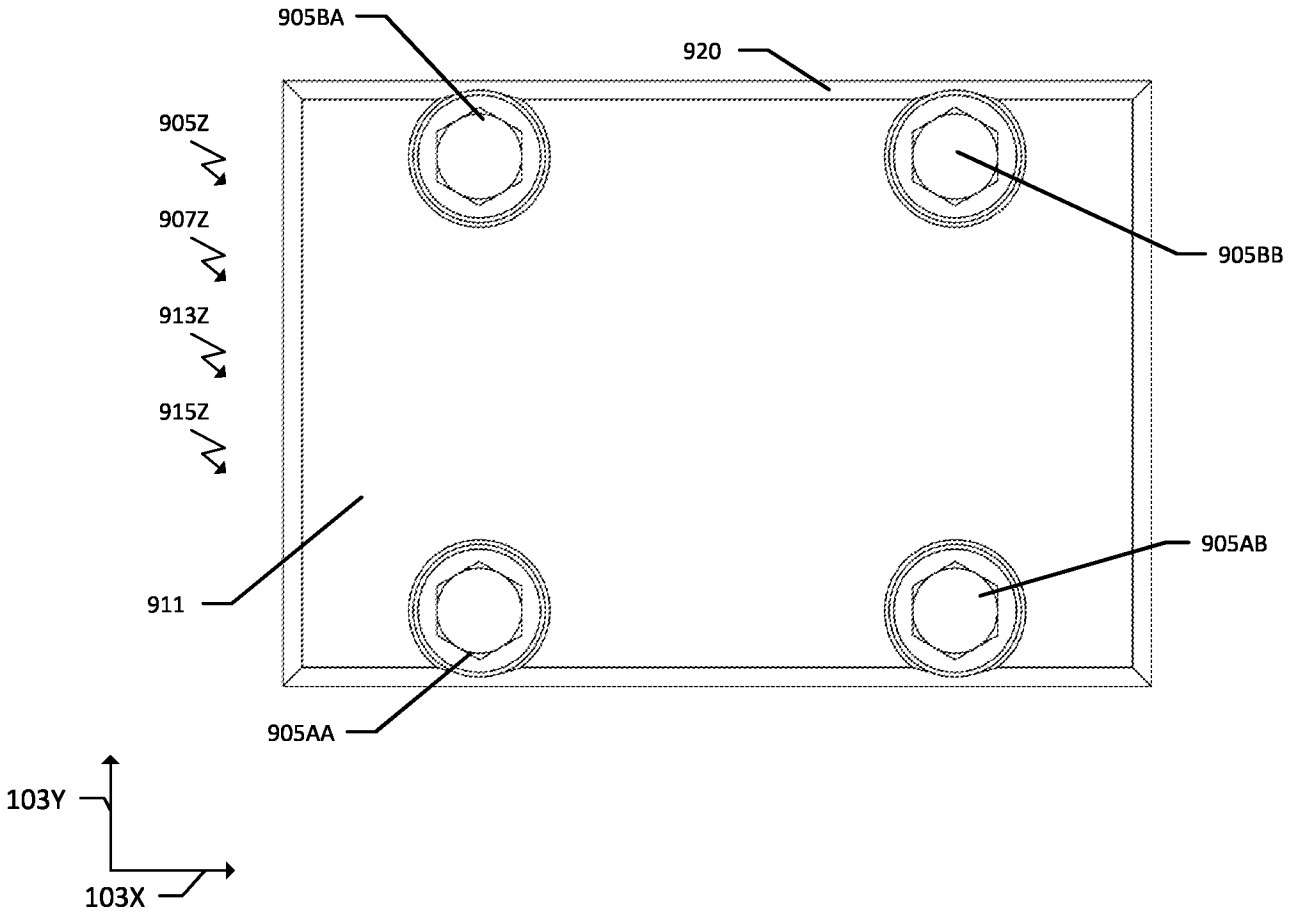
FIG. 9C is a planar view illustrating a sliding assembly, as shown from a top perspective.

FIG. 9C is a planar view illustrating the sliding assembly 901, as shown from a top perspective. The instant view illustrates the plurality of hex bolts 905Z as installed through the plurality of holes 915Z (which is obscured from the instant view).

Figure 9D:
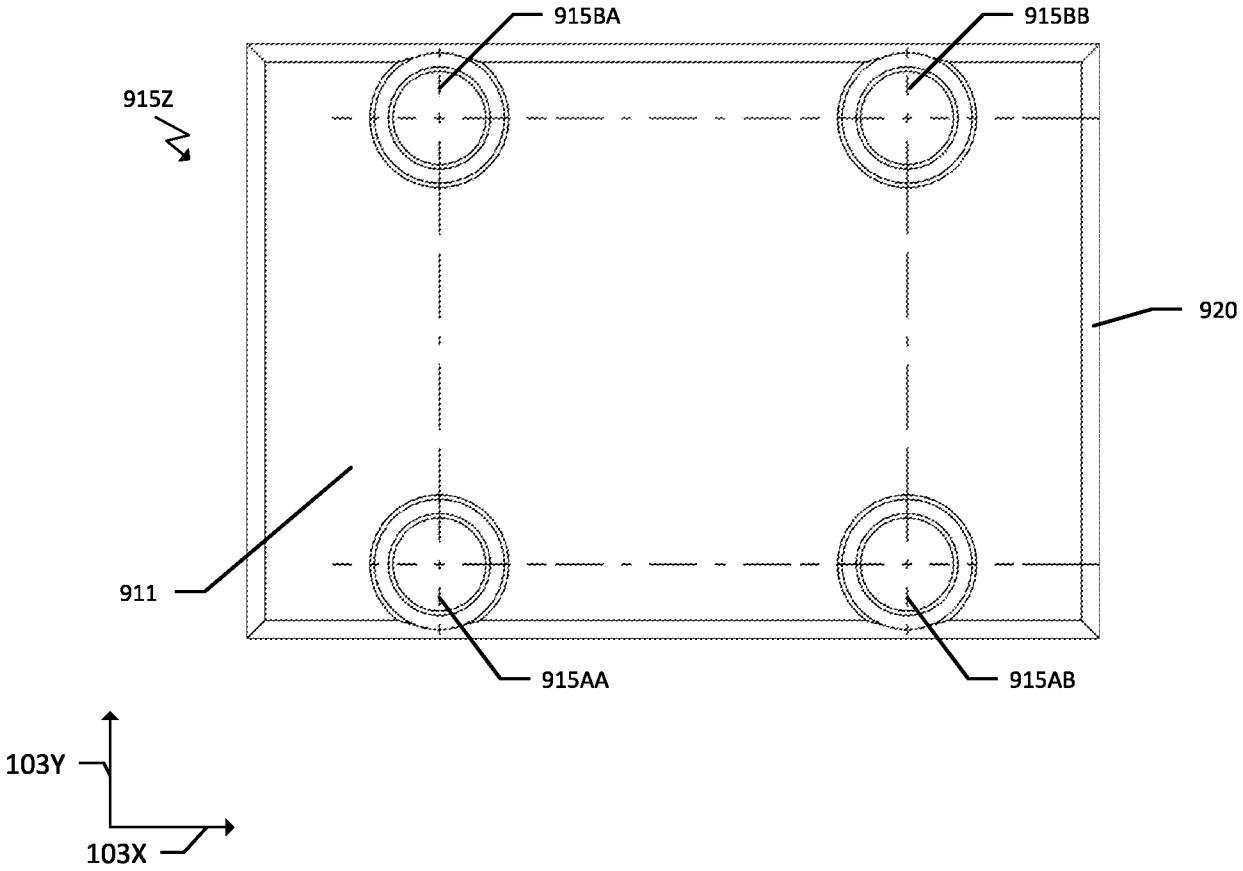
FIG. 9D is a planar view illustrating a slide block, as shown from a top perspective.

FIG. 9D is a planar view illustrating the slide block 911, as shown from a top perspective. The instant view more clearly shows the plurality of holes 915Z.

Figure 9E:
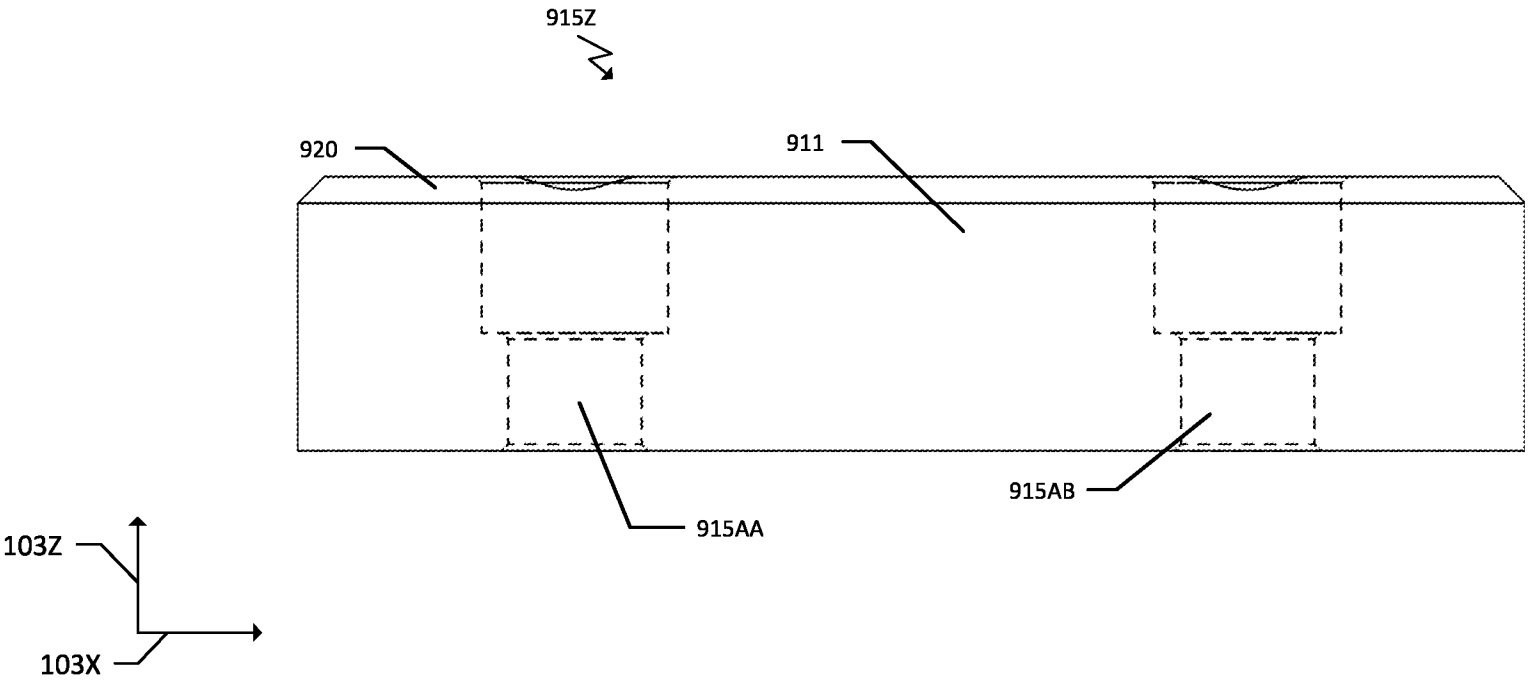
FIG. 9E is a planar view illustrating a slide block, as shown from a side perspective.

FIG. 9E is a planar view illustrating the slide block 911, as shown from a side perspective. The instant view shows the plurality of holes 915Z when the plurality of hex bolts 905Z is not installed.

Figure 9F:
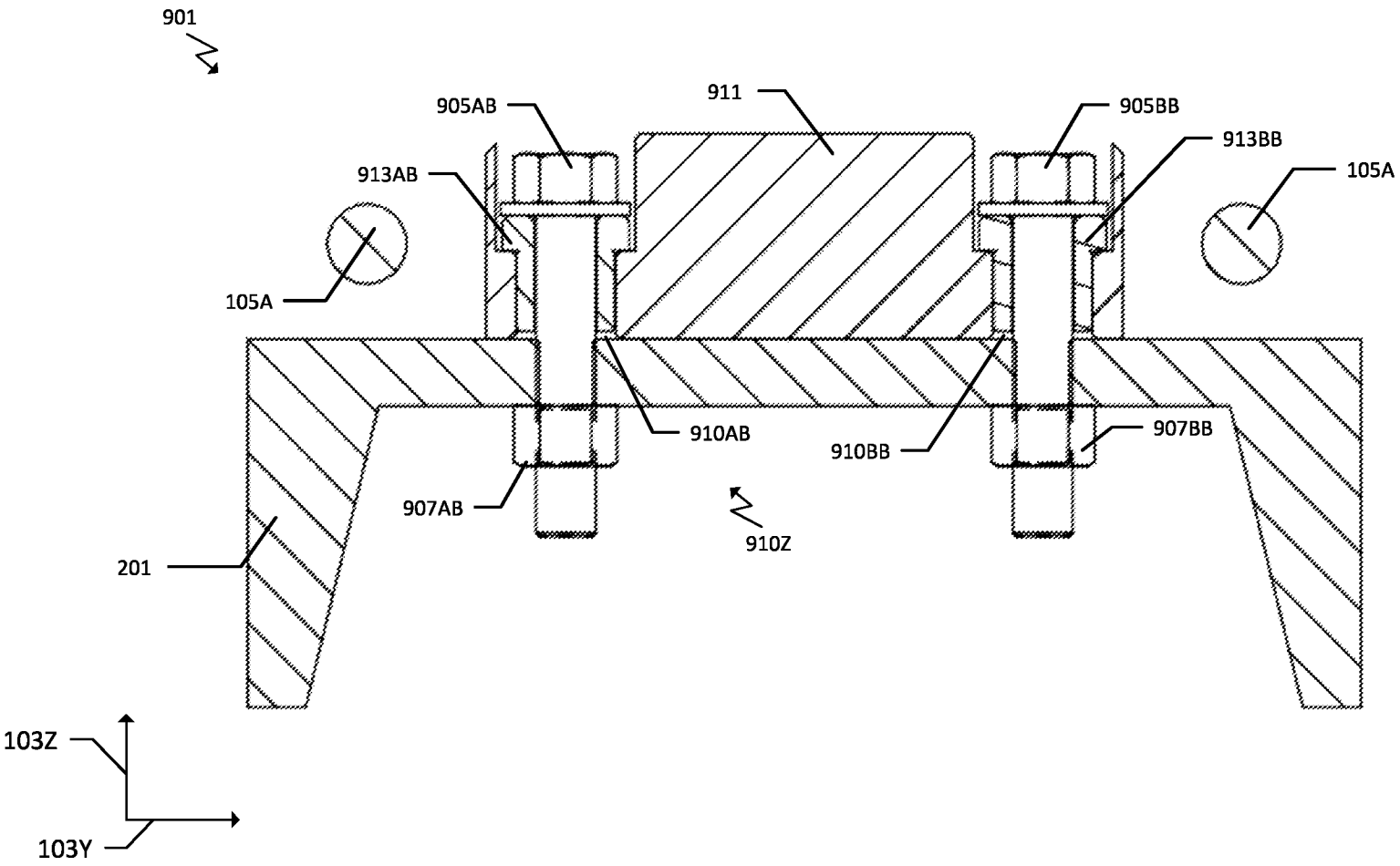
FIG. 9F is a planar view illustrating a sliding assembly, as shown from a side cross-sectional perspective.

FIG. 9F is a planar view illustrating the sliding assembly 901, as shown from a side cross-sectional perspective. The instant view depicts a first gap 910AB between the bushing 913AB and the dorsal surface of the base plate assembly 201. Similarly, a second gap 910BB is shown between the bushing 913BB and the base plate assembly 201. The gaps 910AB. 910BB provide a locking function for the plurality of hex bolts 905Z due to the slight compression of the slide block 911. With excessive force (e.g., torque), the plurality of bushings 913Z will still stop at the dorsal surface of the base plate assembly 201 in order to protect the integrity of the slide block 911. However, the locking functionality will still be generated by the slight compression of the slide block 911 against the dorsal surface of the base plate assembly 201 and the plurality of bushings 913Z.

One of skill in the art will appreciate that each of the plurality of bushings 913Z is disposed over a plurality of gaps 910Z, all of which are substantially similar. The plurality of gaps 910Z comprises the first gap 910AA (not shown in the instant view), the second gap 910AB, a third gap 910BA (not shown in the instant view), and a fourth gap. The distribution of the plurality of gaps 910Z provides for a substantially even locking force for each of the plurality of hex bolts 905Z and the plurality of nuts 907Z, respectively.

Figure 9G:
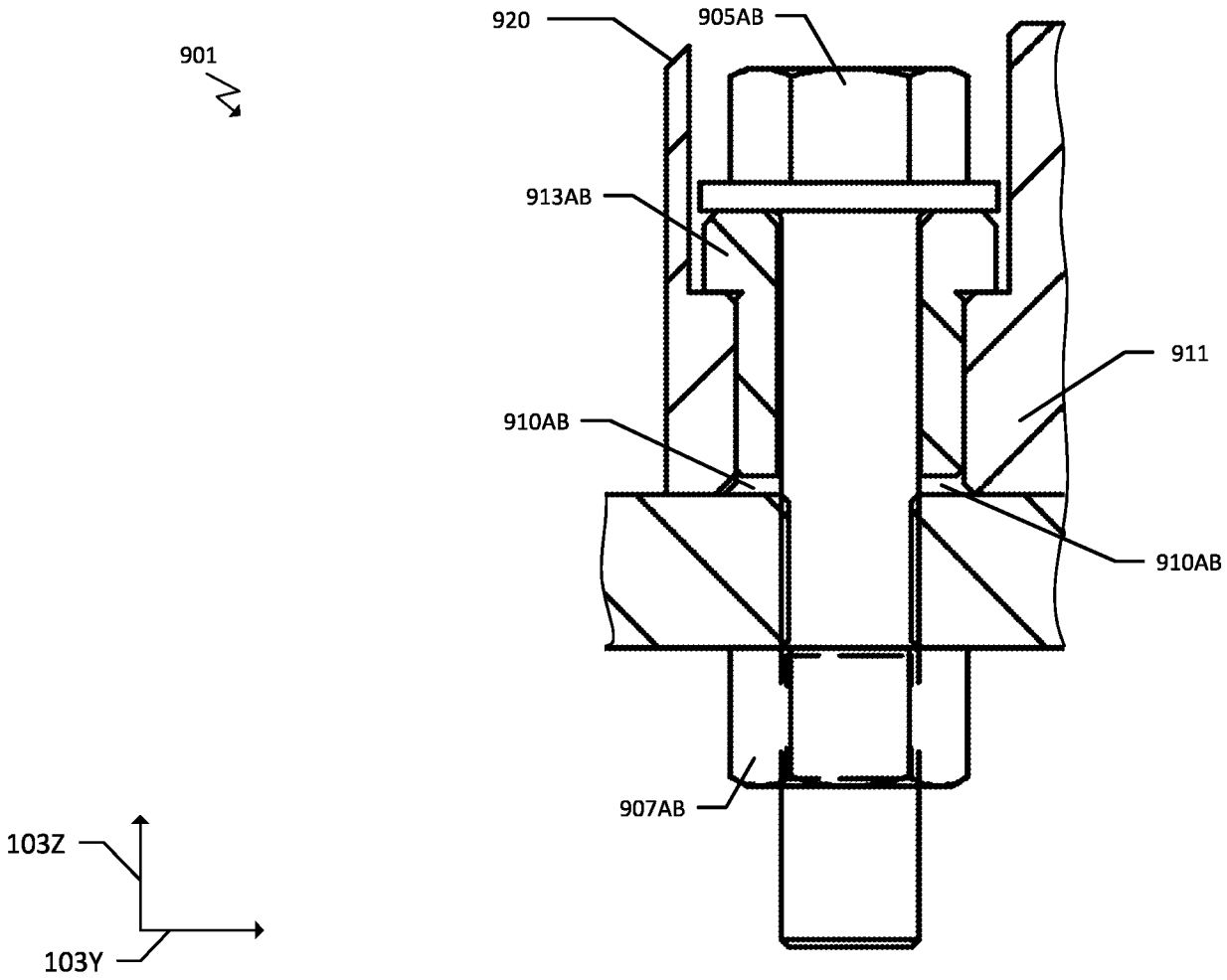
FIG. 9G is a planar view illustrating a sliding assembly, as shown from a side cross-sectional perspective.

FIG. 9G is a planar view illustrating the sliding assembly 901, as shown from a side cross-sectional perspective. The instant view is a cutaway and zoomed-in view of the gap 910AB in order to highlight the size and shape of the plurality of gaps 910Z.

The preceding description of the disclosed aspects is provided to enable any person skilled in the art to make, implement, or use the claims. Various modifications to these aspects will be readily apparent to those skilled in the art, and the generic principles defined herein may be applied to other aspects without departing from the scope of the claims. Thus, the present disclosure is not intended to be limited to the aspects illustrated herein but is to be accorded the widest scope consistent with the claims disclosed herein.

The invention claimed is:

1. A moveable point frog friction-reducing assembly configured for installation at or near a moveable point frog, the moveable point frog friction-reducing assembly comprising:

a first base plate assembly;

a first wing clamp, the first wing clamp being operatively connected at the first base plate assembly;

a second wing clamp, the second wing clamp being operatively connected at the first base plate assembly;

a first horizontal tension assembly, the first horizontal tension assembly being operatively connected to the first wing clamp and the second wing clamp;

a second horizontal tension assembly, the second horizontal tension assembly being operatively connected to the first wing clamp and the second wing clamp;

a first vertical tension assembly, the first vertical tension assembly being operatively connected to the first wing clamp and the first base plate assembly;

a second vertical tension assembly, the second vertical tension assembly being operatively connected to the second wing clamp and the first base plate assembly; and a first friction-reducing assembly, the first friction-reducing assembly being operatively connected to the first base plate assembly.

2. The moveable point frog friction-reducing assembly of claim 1, wherein the friction-reducing assembly is a roller block assembly.

3. The moveable point frog friction-reducing assembly of claim 2, wherein the roller block assembly comprises:

a first roller retainer body;

a first roller assembly, the first roller assembly being operatively connected to the first roller retainer body; and a second roller assembly, the second roller assembly being operatively connected to the first roller retainer body.

4. The moveable point frog friction-reducing assembly of claim 3, wherein the first roller retainer body comprises:

a first roller receiver, the first roller receiver being configured to hold in position the first roller assembly at a first roller axle, the first roller axle being operatively connected to the first roller assembly; and a second roller receiver, the second roller receiver being configured to hold in position the second roller assembly at a second roller axle, the second roller axle being operatively connected to the second roller assembly.

5. The moveable point frog friction-reducing assembly of claim 4, wherein the first roller receiver is configured to hold in position the first roller axle via a first roller axle retainer, the first roller axle retainer comprising:

a first hole, the first hole being configured to receive a first hex screw, the first hole being further configured to retain the first hex screw at or below a dorsal surface of the first roller axle retainer.

6. The moveable point frog friction-reducing assembly of claim 5 wherein the first roller assembly comprises:

a first needle bearing; and a first bushing, the first bushing being operatively connected to the first roller axle and the first needle bearing.

7. The moveable point frog friction-reducing assembly of claim 1, wherein the first vertical tension assembly comprises:

a first bolt, the first hex bolt being disposed through the first wing clamp and the first base plate assembly;

a first plurality of springs, the first bolt being disposed through the first plurality of springs;

a first washer, the first washer being disposed on a dorsal surface of the first plurality of springs;

a first nut, the first nut being disposed at a dorsal surface of the first washer;

a first locking washer, the first locking washer being disposed at a dorsal surface of the first nut; and a first lock nut, the first lock nut being disposed at a dorsal surface of the first locking washer.

8. The moveable point frog friction-reducing assembly of claim 1 wherein the first base plate assembly comprises:

a first plurality of holes, the first plurality of holes being configured to operatively connect to the first friction-reducing assembly; and a second plurality of holes, the second plurality of holes being configured to operatively connect to the first friction-reducing assembly.

9. The moveable point frog friction-reducing assembly of claim 1, wherein the first base plate assembly comprises:

a first hole, the first hole being configured to operatively connect, via the first vertical tension assembly, the first base plate assembly to the first wing clamp;

a first slotted hole, the first slotted hole being configured to operatively connect the first base plate assembly, via the second vertical tension assembly, to the second wing clamp.

10. The moveable point frog friction-reducing assembly of claim 1, wherein the first friction-reducing assembly is a first sliding assembly comprising a first slide block.

11. The moveable point frog friction-reducing assembly of claim 10, wherein the first slide block is ultra-high molecular weight polyethylene ("UHMWPE"), high-density polyethylene ("HDPE"), low-density polyethylene ("LDPE"), polytetrafluoroethylene ("PTFE"), acetal plastic, or a combination thereof.

12. The moveable point frog friction-reducing assembly of claim 10, wherein the slide block further comprises:

a ramp, the ramp being disposed about a perimeter of a dorsal surface of the slide block; and a plurality of holes, the plurality of holes being configured to support a plurality of bushings, the plurality of bushings being configured to compress the slide block and cause a plurality of bolts to lock into position when the slide block is installed into the base plate assembly.

13. A sliding assembly configured for installation in a moveable point frog friction-reducing assembly, the sliding assembly comprising:

a slide block being comprised of ultra-high molecular weight polyethylene ("UHMWPE" high-density polyethylene ("HDPE"), low-density polyethylene ("LDPE"), polytetrafluoroethylene ("PTFE"), acetal plastic, or a combination thereof, the slide block further comprising:

a ramp, the ramp being disposed about a perimeter of a plurality of dorsal surfaces of the slide block; and a plurality of holes, the plurality of holes being configured to support a plurality of bushings, the plurality of bushings being configured to compress the slide block and cause the plurality of bolts to lock into position when the slide block is installed into a base plate assembly:

the first plurality of bushings, the first plurality of bushings being disposed in a first plurality of holes within the slide block, respectively; and a first plurality of bolts, the first plurality of bolts being disposed at a plurality of dorsal surfaces of the first plurality of bushings, respectively, wherein the first plurality of bolts is configured to receive a first plurality of nuts, the first plurality of nuts being configured to secure the first plurality of bolts to a surface of the base plate assembly, further wherein the plurality of dorsal surfaces of the first plurality of bushings is configured to receive the first plurality of bolts at or below the plurality of dorsal surfaces of the slide block.

* * * * *